US010933677B2

(12) United States Patent
Kamijo

(10) Patent No.: US 10,933,677 B2
(45) Date of Patent: Mar. 2, 2021

(54) RECORDING DEVICE AND RECORDING METHOD FOR RECORDING DEVICE

(71) Applicant: SEIKO EPSON CORPORATION, Tokyo (JP)

(72) Inventor: Kimitaka Kamijo, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/363,312

(22) Filed: Mar. 25, 2019

(65) Prior Publication Data

US 2019/0291491 A1 Sep. 26, 2019

(30) Foreign Application Priority Data

Mar. 26, 2018 (JP) ..... JP2018-057634

(51) Int. Cl.
*B41M 5/00* (2006.01)
*B41J 2/21* (2006.01)

(52) U.S. Cl.
CPC ..... *B41M 5/0017* (2013.01); *B41J 2/2114* (2013.01)

(58) Field of Classification Search
None
See application file for complete search history.

(56) References Cited

U.S. PATENT DOCUMENTS

2002/0196303 A1 12/2002 Koitabashi et al.
2006/0109326 A1* 5/2006 Nakazawa ..... B41J 11/009 347/101
2015/0197654 A1* 7/2015 Okuda ..... B41M 5/0017 347/21

FOREIGN PATENT DOCUMENTS

JP 2000-190480 A 7/2000
JP 2015-147405 A 8/2015

* cited by examiner

*Primary Examiner* — Erica S Lin
(74) *Attorney, Agent, or Firm* — Chip Law Group

(57) ABSTRACT

Provided are a head unit, feeding rollers configured to feed a medium, a carriage configured to cause the head unit to perform scanning, and a control unit configured to control the head unit, the feeding rollers, and the carriage. The control unit performs recording with a first ink and a first reaction solution to form a first layer onto the medium by a first pass operation, performs recording with the first ink to form a second layer on the first layer by a second pass operation, performs recording with a second ink and a second reaction solution to form a third layer on the second layer by a third pass operation, and performs recording with the second ink to form a fourth layer on the third layer by a fourth pass operation.

7 Claims, 17 Drawing Sheets

RECORDING DEVICE AND RECORDING METHOD FOR RECORDING DEVICE

BACKGROUND

1. Technical Field

The invention relates to a recording device and a recording method for the recording device.

2. Related Art

Traditionally, a recording device configured to perform recording by using inks and a reaction solution formed to act on the inks has been known (JP-A-2000-190480).

The ink-jet recording device (recording device) described in JP-A-2000-190480 includes a head configured to perform recording with a reaction solution and inks onto a medium, and is capable of performing a recording control to automatically determine a kind of a medium to be used, and to achieve recording with an appropriate reaction solution and inks in accordance with the kind of the medium. Recording with the reaction solution is performed on a surface of the medium beforehand, and, while a liquid component of the reaction solution is remaining on the surface, the inks are allowed to land. With increased bonding power among color materials contained in the inks, the inks are then fixed onto the medium. As a result, the inks are suppressed from spreading excessively.

However, in the recording device described in JP-A-2000-190480, recording with the inks and recording with the reaction solution are separately performed. This means that recording with reaction solution is further required, in addition to recording with the inks, lowering productivity.

SUMMARY

A recording device according to the application includes a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, the first nozzle group, the second nozzle group, and the third nozzle group overlapping in an arrangement direction of the nozzles, a feeder configured to feed a medium in a feeding direction relatively to the recording unit, a scanner configured to cause the recording unit to perform scanning relative to the medium in a scanning direction intersecting with the feeding direction, and a controller configured to control the recording unit, the feeder, and the scanner to repeat, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The controller performs recording with the first liquid and the reaction solution to form a first layer on the medium by a first pass operation, performs recording with the first liquid to form a second layer on the first layer by a second pass operation after the first pass operation, performs recording with the second liquid and the reaction solution to form a third layer on the second layer by a third pass operation after the second pass operation, and performs recording with the second liquid to form a fourth layer on the third layer by a fourth pass operation after the third pass operation.

A recording device according to the application includes a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, a feeder configured to feed a medium in a feeding direction relatively to the recording unit, a scanner configured to cause the recording unit to perform scanning relatively to the medium in a scanning direction intersecting with the feeding direction, and a controller configured to control the recording unit, the feeder, and the scanner to repeat, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording unit includes an overlapping part where the first nozzle group and the third nozzle group overlap in an arrangement direction of the nozzles, an upstream-side non-overlapping part provided with the third nozzle group upstream of the overlapping part in the feeding direction, and a downstream-side non-overlapping part provided with the second nozzle group downstream of the overlapping part in the feeding direction. The controller performs recording with the reaction solution from the upstream-side non-overlapping part to form a first layer on the medium by a first pass operation, performs recording with the first liquid and the reaction solution from the overlapping part to form a second layer on the first layer by a second pass operation after the first pass operation, and performs recording with the second liquid from the downstream-side non-overlapping part to form a third layer on the second layer by a third pass operation after the second pass operation.

A recording device according to the application includes a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, a feeder configured to feed a medium in a feeding direction relatively to the recording unit, a scanner configured to cause the recording unit to perform scanning relatively to the medium in a scanning direction intersecting with the feeding direction, and a controller configured to control the recording unit, the feeder, and the scanner to repeat, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording unit includes an overlapping part where the third nozzle group and the first nozzle group or the second nozzle group overlap in an arrangement direction of the nozzles, and non-overlapping part provided with the first nozzle group or the second nozzle group downstream of the overlapping part in the feeding direction. The controller performs recording with the second liquid and the reaction solution from the overlapping part to form a first layer onto the medium in a first pass operation, performs recording with the second liquid from the non-overlapping part to form a second layer on the first layer by a second pass operation after the first pass operation, performs recording with the first liquid and the reaction solution from the overlapping part to form a third layer on the second layer by a third pass operation after the second pass operation, performs recording with the first liquid from the non-overlapping part to form a fourth layer on the third layer by a fourth pass operation after the third pass operation, and performs recording with the second liquid from the non-overlapping part to form a fifth layer on the fourth layer by a fifth pass operation after the fourth pass operation.

It is preferable that, in a recording device according to the application, the first liquid be a white ink, and the second liquid be color inks.

A recording method according to the application is used for a recording device including a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, the first nozzle group, the second nozzle group, and the third nozzle group overlapping in an arrangement direction of the nozzles, a feeder configured to feed a medium in a feeding direction relatively to the recording unit, and a scanner configured to cause the recording unit to perform scanning relatively to the medium in a scanning direction intersecting with the feeding direction. The recording device is configured to perform recording by repeating, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording method for the recording device includes performing recording with the first liquid and the reaction solution to form a first layer on the medium by a first pass operation, performing recording with the first liquid to form a second layer on the first layer by a second pass operation after the first pass operation, performing recording with the second liquid and the reaction solution to form a third layer on the second layer by a third pass operation after the second pass operation, and performing recording with the second liquid to form a fourth layer on the third layer by a fourth pass operation after the third pass operation.

A recording method according to the application is used for a recording device including a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, a feeder configured to feed a medium in a feeding direction relatively to the recording unit, and a scanner configured to cause the recording unit to perform scanning relatively to the medium in a scanning direction intersecting with the feeding direction. The recording unit includes an overlapping part where the first nozzle group and the third nozzle group overlap in an arrangement direction of the nozzles, an upstream-side non-overlapping part provided with the third nozzle group upstream of the overlapping part in the feeding direction, and a downstream-side non-overlapping part provided with the second nozzle group downstream of the overlapping part in the feeding direction. The recording device is configured to perform recording by repeating, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording method for the recording device includes performing recording with the reaction solution from the upstream-side non-overlapping part to form a first layer on the medium by a first pass operation, performing recording with the first liquid and the reaction solution from the overlapping part to form a second layer on the first layer by a second pass operation after the first pass operation, and performing recording with the second liquid from the downstream-side non-overlapping part to form a third layer on the second layer by a third pass operation after the second pass operation.

A recording method according to the application is used for a recording device including a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are formed, a feeder configured to feed a medium in a feeding direction relatively to the recording unit, and a scanner configured to cause the recording unit to perform scanning relatively to the medium in a scanning direction intersecting with the feeding direction. The recording unit includes an overlapping part where the third nozzle group and the first nozzle group or the second nozzle group overlap in an arrangement direction of the nozzles, and a non-overlapping part provided with the first nozzle group or the second nozzle group downstream of the overlapping part in the feeding direction. The recording device is configured to perform recording by repeating, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording method for the recording device including performing recording with the second liquid and the reaction solution from the overlapping part to form a first layer on the medium by a first pass operation, performing recording with the second liquid from the non-overlapping part to form a second layer on the first layer by a second pass operation after the first pass operation, performing recording with the first liquid and the reaction solution from the overlapping part to form a third layer on the second layer by a third pass operation after the second pass operation, performing recording with the first liquid from the non-overlapping part to form a fourth layer on the third layer by a fourth pass operation after the third pass operation, and performing recording with the second liquid from the non-overlapping part to form a fifth layer on the fourth layer by a fifth pass operation after the fourth pass operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will be described below with reference to the accompanying drawings. The exemplary embodiments illustrate some aspects of the invention, and do not limit the invention in any way. The exemplary embodiments can be modified as desired without departing from the scope of the technical concept of the invention. Additionally, in each of the following drawings, to make each layer, each member, and the like recognizable in terms of size, each of the layers, members, and the like is illustrated in a scale different from an actual scale.

Exemplary Embodiment 1

Figure 1:
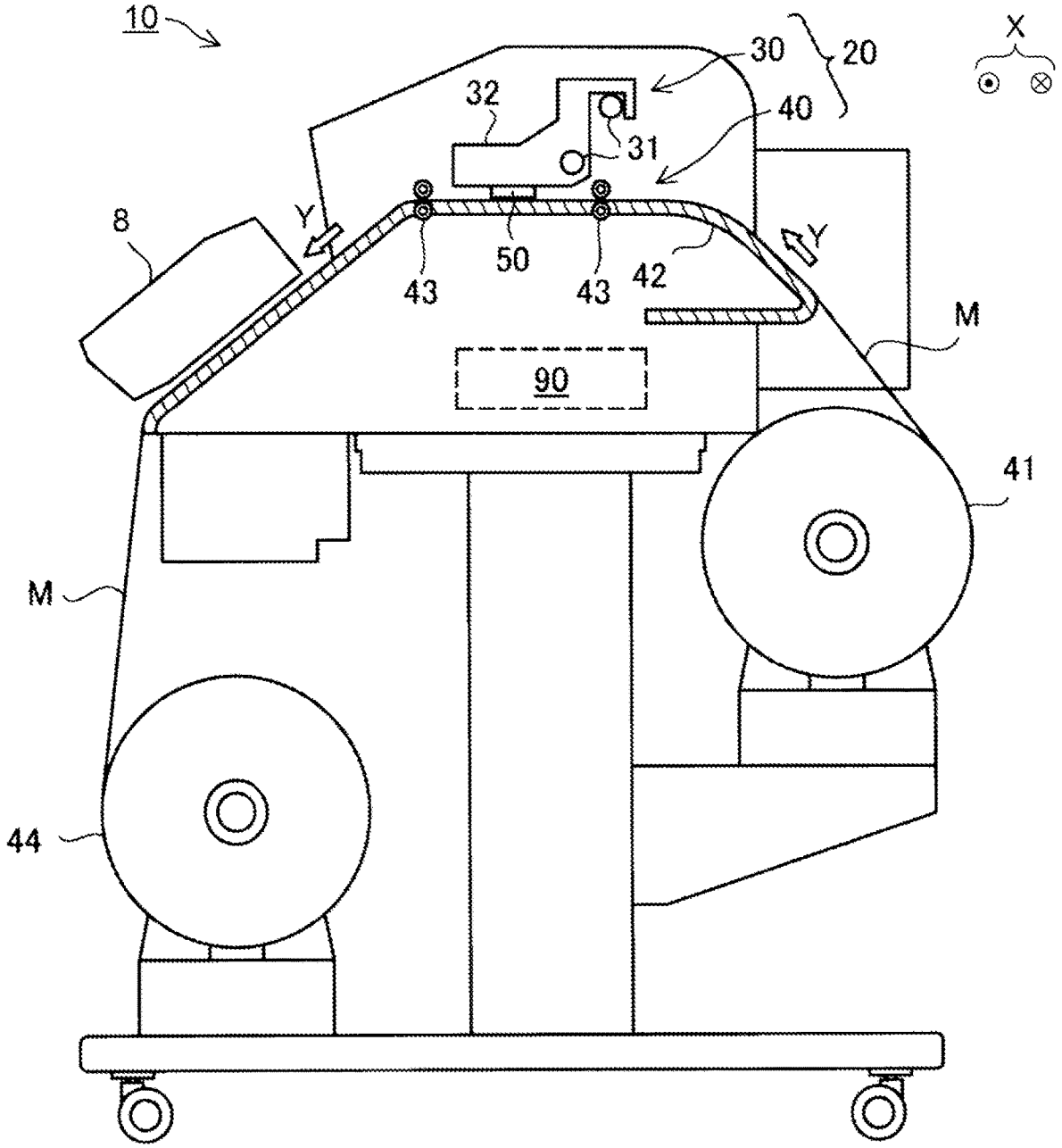
FIG. 1 is a schematic diagram illustrating an overview of a recording device according to Exemplary Embodiment 1.
Figure 2:
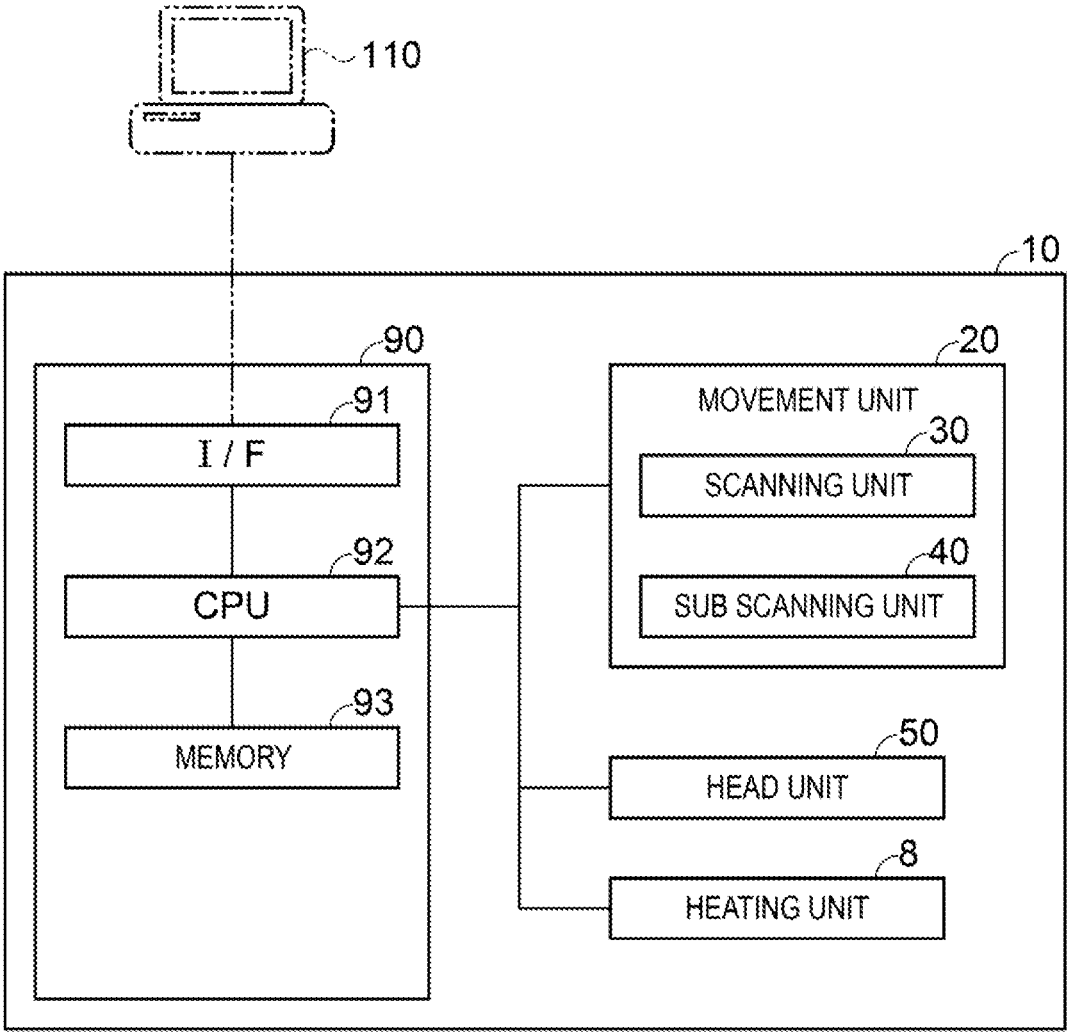
FIG. 2 is a block diagram illustrating an electrical configuration of the recording device according to Exemplary Embodiment 1.
Figure 3:
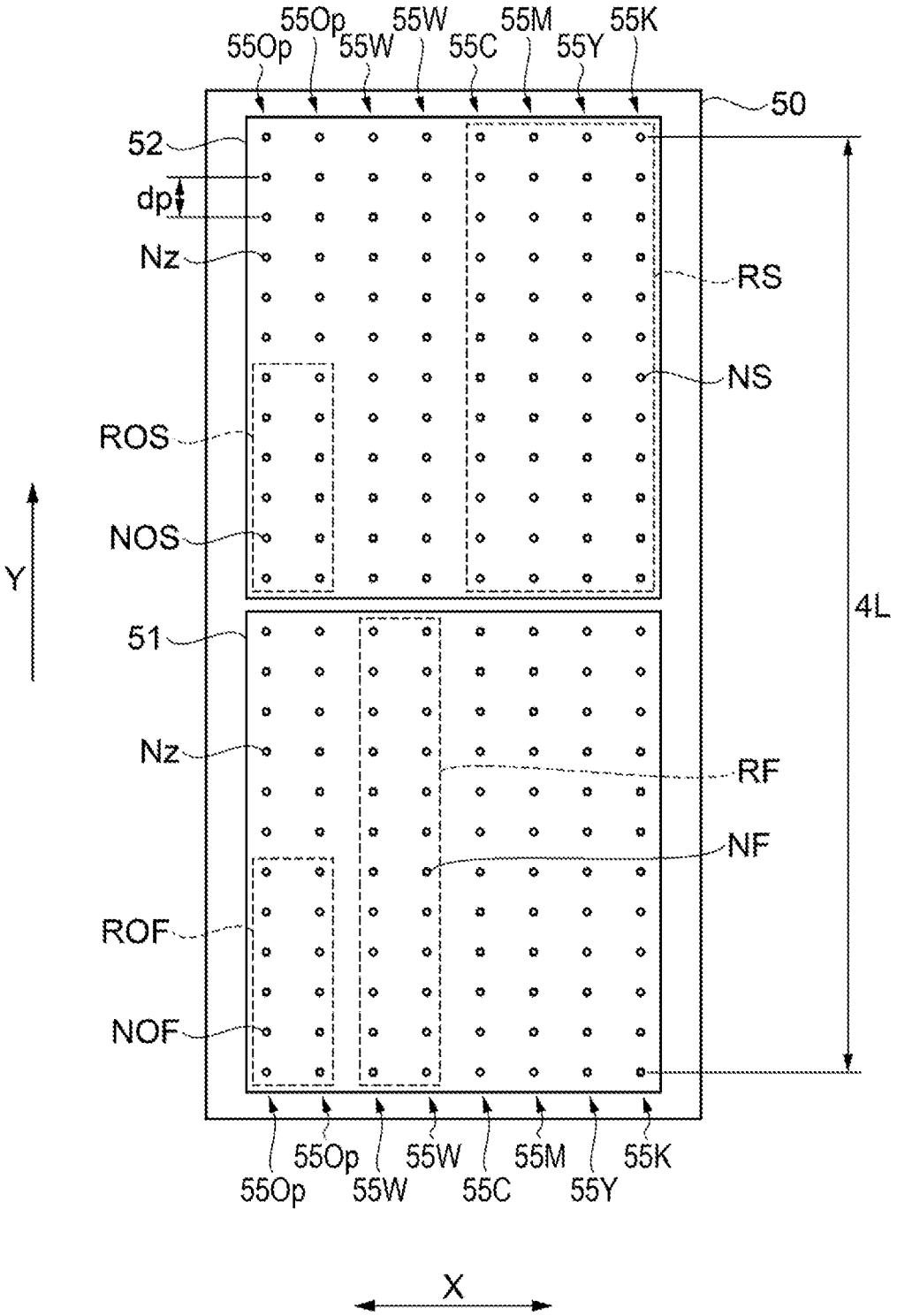
FIG. 3 is a schematic view illustrating an arrangement state of nozzles included in a head unit.

FIG. 1 is a schematic diagram illustrating an overview of a recording device according to Exemplary Embodiment 1. FIG. 2 is a block diagram illustrating an electrical configuration of the recording device according to the exemplary embodiment. FIG. 3 is a schematic view illustrating an arrangement state of nozzles included in a head unit.

FIG. 3 illustrates a state of a head unit 50 when viewed from a medium M.

First of all, an overview of a recording device 10 according to the exemplary embodiment will be described with reference to FIGS. 1 to 3.

Overview of Recording Device

As illustrated in FIGS. 1 and 2, the recording device 10 according to the exemplary embodiment is a large format printer (LFP) configured to perform recording of a predetermined image onto the long medium M based on image data to be output from a computer (personal computer or PC) 110 serving as an external device.

The recording device 10 may be configured to directly acquire image data from a recording medium such as an optical disk (CD-ROM or DVD, for example) or a memory card, for example, and to perform recording of a predetermined image onto the medium M based on the image data.

The recording device 10 according to the exemplary embodiment first performs recording with a white ink W onto the clear medium M to perform recording of a background image BG (see FIG. 7) onto the clear medium M. Next, the recording device 10 performs recording with four color inks C, M, YE, and K of cyan, magenta, yellow, and black to perform recording of a full color image FC (see FIG. 7) on the background image BG. The medium M is not limited to the clear medium, but may be an opaque medium.

The inks W, C, M, YE, and K are aqueous pigment inks each containing a solvent (water), pigments (color materials), and a resin emulsion (or, fine resin particles). The pigments have undergone distribution processing. Surfaces of the pigments are thus electrically charged. Therefore, the pigments repelling each other due to static electricity are distributed evenly in water.

The white ink W is an example of a "first liquid", and will sometimes be referred to as a first ink F. The four color inks C, M, YE, and K of cyan, magenta, yellow, and black are examples of "second liquids" or "color inks", and will be referred to as second inks S.

The first ink F forms the white background image BG on the clear medium M. The second inks S form the full color image FC on the white background image BG.

The medium M is a non-absorption medium or a low absorption medium made of a material that is less likely to absorb the inks F and S. For example, as a material for the medium M, polyethylene terephthalate, polypropylene, or vinyl chloride, for example, may be used. Since the medium M is made of a material that is less likely to absorb the inks F and S, the inks F and S are repelled by the medium M, and are less likely to be fixed onto the medium M.

A reaction solution Op is used to allow the inks F and S to wet-spread on a surface of the medium M, and to allow the inks F and S to be fixed at target positions on the medium M.

The reaction solution Op contains a solvent (water), a flocculant, and a surfactant. The flocculant may be multivalent metal salt that can cause flocculation reactions in pigments, such as calcium acetate, calcium nitrate, or magnesium sulfate. The flocculant contained in the reaction solution Op neutralizes electric charge on surfaces of the pigments to allow the pigments to flocculate. The surfactant contained in the reaction solution Op improves wettability of the inks F and S with respect to the medium M. The surfactant may be an acetylene glycol-based surfactant, a fluorine-based surfactant, or a silicone-based surfactant, for example.

The surfactant causes the inks F and S to easily and evenly wet-spread on the surface of the medium M. Further, the pigments contained in the inks F and S are flocculated by the flocculant, and settle down on the surface of the medium M to adhere at the target positions on the medium M.

To allow the inks F and S to be appropriately fixed onto the medium M, the reaction solution Op is required to act at an appropriate liquid volume on the inks F and S used for recording onto the medium M.

For example, if a liquid volume of the reaction solution Op used for recording onto the medium M is too small with respect to liquid volumes of the inks F and S used for recording onto the medium M, the surfactant is unable to allow the inks F and S to fully wet-spread, and also the flocculant is unable to allow the pigments to evenly flocculate. For example, if a liquid volume of the reaction solution Op used for recording onto the medium M is too great with respect to liquid volumes of the inks F and S used for recording onto the medium M, the excessive flocculant lowers adhesiveness of the pigments to the medium M. Further, a great amount of water contained in the reaction solution Op may increase the time needed for drying the medium M. Further, the excessive flocculant lowers adhesiveness of the inks F and S to the medium M.

Hereinafter, the reaction solution Op formed to act on the first ink F will be referred to as a first reaction solution OF, whereas the reaction solution Op formed to act on the second inks S will be referred to as a second reaction solution OS. The first reaction solution OF and the second reaction solution OS are identical to each other, i.e., the reaction solution Op, but are different in liquid volume. That is, the first reaction solution OF is the reaction solution Op at an appropriate liquid volume with respect to a liquid volume of the first ink F, whereas the second reaction solution OS is the reaction solution Op at an appropriate liquid volume with respect to liquid volumes of the second inks S.

A liquid volume for the first reaction solution OF formed to act on the first ink F and a liquid volume for the second reaction solution OS formed to act on the second inks S will be set in color conversion processing, described later (step S2 (see FIG. 4)).

The recording device 10 includes a movement unit 20, the head unit 50 representing an example of a "recording unit", a heating unit 8, and a control unit 90 representing an example of a "controller".

The movement unit 20 causes the medium M and the head unit 50 to move and perform recording of an image onto the medium M. The movement unit 20 includes a sub scanning unit 40 and a scanning unit 30. The sub scanning unit 40 feeds the medium M in a feeding direction Y denoted by a white hollow arrow in the drawing to allow the medium M to pass through in a vicinity of the head unit 50 and a vicinity of the heating unit 8.

The sub scanning unit 40 includes a feeding unit 41, a support unit 42, feeding rollers 43 representing an example of a "feeder", and a winding unit 44. The feeding unit 41 causes a driving motor (not illustrated) to rotate to feed the medium M wound in a roll shape and to be subjected to recording. The support unit 42 supports the medium M being fed in the feeding direction Y. The feeding rollers 43 are respectively arranged upstream in the feeding direction Y of the head unit 50 and downstream in the feeding direction Y of the head unit 50.

As the driving motor (not illustrated) rotates, the feeding rollers 43 feed the medium M on the support unit 42 in the feeding direction Y. That is, the feeding rollers 43 feed the medium M in the feeding direction Y relative to the head unit 50. The winding unit 44 winds the medium M having undergone recording.

The scanning unit 30 causes the head unit 50 to move in a scanning direction X relative to the medium M. The scanning direction X is a direction intersecting with the feeding direction Y. The scanning unit 30 includes guide shafts 31 and a carriage 32, representing an example of a "scanner". The guide shafts 31 are two stick-shaped members, and extend in a longitudinal direction parallel to the scanning direction X. The guide shafts 31 extend in the scanning direction X and support the carriage 32 to be movable.

The carriage 32 is mounted with the head unit 50, and is driven by a carriage motor (not illustrated) to reciprocate along the guide shafts 31 in the scanning direction X. That is, the carriage 32 is mounted with the head unit 50, and causes the head unit 50 to move in the scanning direction X intersecting with the feeding direction Y relative to the medium M.

The head unit 50 is arranged to face the medium M, and reciprocates in the scanning direction X as the carriage 32 reciprocates.

The recording device 10 alternately repeats allowing the head unit 50 to keep performing recording with at least one of the inks F and S and the reaction solutions OF and OS, and to move in the scanning direction X, i.e., main scanning, and allowing the medium M to move in the feeding direction Y, i.e., sub scanning, to perform recording of the white background image BG and the full color image FC in order onto the medium M. A distance at which the medium M moves at a feeding movement (sub scanning) is a length L.

In other words, the recording device 10 repeats, while allowing the head unit 50 to keep performing scanning relative to the medium M, i.e., scanning operation, allowing nozzles Nz (see FIG. 3) to perform recording with at least one of the inks F and S and the reaction solutions OF and OS onto the medium M, i.e., pass operation, and allowing the head unit 50 to move relative to the medium M, i.e., feeding operation.

Hereinafter, one main scanning will sometimes be referred to as a "pass operation". That is, the pass operation according to the application denotes that the head unit 50 keeps performing recording with at least one of the inks F and S and the reaction solutions OF and OS and moves in the scanning direction X.

The heating unit 8 is disposed downstream in the feeding direction Y of the head unit 50. The heating unit 8 heats the medium M having passed through the head unit 50 to allow solvent components in the inks F and S and the reaction solutions OF and OS on the medium M to evaporate and dry. Further, the heating unit 8 allows resin components in the inks F and S to melt, a resin layer containing the pigments in the inks F and S to be formed, and the pigments to be fixed onto the medium M.

The heating unit 8 internally includes a heating element (not illustrated), and blows heated air and radiates infrared rays to heat the medium M. Note that one of the blowing of the heated air and the radiation of the infrared rays may be omitted, and a heating device employing any other method may be used as the heating unit 8. Additionally, a length in the scanning direction X of the heating unit 8 may be identical to a length in the scanning direction X of the medium M, or may be greater than the length in the scanning direction X of the medium M.

The control unit 90 is a controller configured to control the recording device 10 wholly. The control unit 90 includes an interface (I/F) 91, a central processing unit (CPU) 92, and a memory 93, for example.

The I/F 91 allows data to be exchanged between the PC 110 and the recording device 10. The PC 110 and the recording device 10 may be connected directly with a cable or the like, or indirectly through a network or the like. Further, data transmission and reception may be performed between the PC 110 and the recording device 10 via wireless communication.

The CPU 92 is an arithmetic processing unit for overall control of the recording device 10.

The memory 93 is a storage medium that secures a region for storing programs to be executed by the CPU 92, a work region for running such programs, and the like, and includes storage elements such as a RAM and an EEPROM.

The control unit 90 creates recording data based on image data output from the PC 110, and controls the movement unit 20, the head unit 50, and the heating unit 8, for example, in accordance with the recording data. Specifically, the control unit 90 controls the head unit 50, the feeding rollers 43, and the carriage 32 to repeat, while allowing the head unit 50 to keep performing scanning relative to the medium M, i.e., scanning operation, allowing the nozzles Nz to perform recording with at least one of the inks F and S and the reaction solutions OF and OS onto the medium M, i.e., pass operation (main scanning), and allowing the head unit 50 to move relative to the medium M, i.e., feeding operation (sub scanning), to perform recording of the white background image BG and the full color image FC in order onto the medium M.

As illustrated in FIG. 3, the head unit 50 includes two nozzle tips 51 and 52 (a first nozzle tip 51 and a second nozzle tip 52) configured to perform recording with the color (white, cyan, magenta, yellow, black) inks W, C, M, YE, and K (inks F and S) and the reaction solution Op (reaction solutions OF and OS). The first nozzle tip 51 is arranged upstream in the feeding direction Y of the second nozzle tip 52.

The nozzle tips 51 and 52 are parts having structures configured to each perform recording with one or any of the inks F and S and the reaction solutions OF and OS. The "nozzle tips 51 and 52" are parts produced by integrating the nozzles Nz, piezoelectric elements (not illustrated), and ink chambers (not illustrated) through a semiconductor manufacturing technology (so-called MEMS).

Surfaces of the nozzle tips 51 and 52 face the medium M, and are formed with a plurality of the nozzles Nz configured to perform recording with the inks F and S and the reaction solution Op (reaction solutions OF and OS). The nozzles Nz are arranged at constant intervals (nozzle pitch dp) in the feeding direction Y to form nozzle groups 55.

The nozzle groups 55 include nozzle groups 55W arranged with the nozzles Nz configured to perform recording with the white ink W, nozzle groups 55C arranged with the nozzles Nz configured to perform recording with the cyan ink C, nozzle groups 55M arranged with the nozzles Nz configured to perform recording with the magenta ink M, nozzle groups 55Y arranged with the nozzles Nz configured to perform recording with the yellow ink YE, nozzle groups 55K arranged with the nozzles Nz configured to perform recording with the black ink K, and nozzle groups 55Op arranged with the nozzles Nz configured to perform recording with the reaction solution Op formed to act on the inks W, C, M, YE, and K.

The nozzle groups 55W constitute an example of a "first nozzle group", the nozzle groups 55C, 55M, 55Y, and 55K constitute an example of a "second nozzle group", and the nozzle groups 55Op constitute an example of a "third nozzle group". Further, the feeding direction Y in which the nozzles Nz are arranged at constant intervals (nozzle pitch dp) is an example of an "arrangement direction of the nozzles".

As described above, the nozzle tips 51 and 52 (head unit 50) respectively include the nozzle groups 55W arranged with the nozzles Nz configured to perform recording with the ink W (first ink F), the nozzle groups 55C, 55M, 55Y, and 55K arranged with the nozzles Nz respectively configured to perform recording with the inks C, M, YE, and K (second inks S), and the nozzle groups 55Op arranged with the nozzles Nz configured to perform recording with the reaction solution Op (reaction solutions OF and OS) formed to act on the inks W, C, M, YE, and K (inks F and S).

The nozzle groups 55Op arranged with the nozzles Nz configured to perform recording with the reaction solutions OF and OS are respectively arranged at ends of the nozzle tips 51 and 52 (head unit 50). The nozzle groups 55K, the nozzle groups 55Y, the nozzle groups 55M, the nozzle groups 55C, the nozzle group 55W, the nozzle group 55W, the nozzle group 55Op, and the nozzle group 55Op are respectively arranged in order in the scanning direction X.

On the head unit 50, positions of the nozzle groups 55K in the feeding direction Y, positions of the nozzle groups 55Y in the feeding direction Y, positions of the nozzle groups 55M in the feeding direction Y, positions of the nozzle groups 55C in the feeding direction Y, positions of the nozzle groups 55W in the feeding direction Y, and positions of the nozzle groups 55Op in the feeding direction Y are identical to each other.

The expression "overlap each other in the arrangement direction of the nozzles" in the application denotes that positions in the feeding direction Y are identical to each other. Therefore, the head unit 50 has a configuration in which the nozzle groups 55W arranged with the nozzles Nz configured to perform recording with the first ink F, the nozzle groups 55C, 55M, 55Y, and 55K arranged with the nozzles Nz configured to perform recording with the second inks S, and the nozzle groups 55Op arranged with the nozzles Nz configured to perform recording with the reaction solutions OF and OS formed to act on the inks F and S overlap each other in the direction in which the nozzles Nz are arranged (feeding direction Y).

Further, when viewed in the scanning direction X, the nozzles Nz arranged in the nozzle groups 55W, the nozzles Nz arranged in the nozzle groups 55C, 55M, 55Y, and 55K, and the nozzles Nz arranged in the nozzle groups 55Op overlap each other when viewed in a plan view.

An interval between one of the nozzles Nz at a downstream-side end in the feeding direction Y of the first nozzle tip 51 and one of the nozzles Nz at an upstream-side end in the feeding direction Y of the second nozzle tip 52 is equal to the nozzle pitch dp between the nozzle tips 51 and 52. Therefore, the nozzle tips 51 and 52 can be regarded as a single nozzle tip arranged with the nozzles Nz in the feeding direction Y at the nozzle pitch dp.

Note that such a configuration may be adopted that, when viewed in the scanning direction X, the nozzles Nz arranged at the downstream-side end in the feeding direction Y of the first nozzle tip 51 and the nozzles Nz arranged at the upstream-side end in the feeding direction Y of the second nozzle tip 52 may overlap each other when viewed in a plan view.

A distance between one of the nozzles Nz at an upstream-side end in the feeding direction Y in the first nozzle tip 51 and one of the nozzles Nz at a downstream-side end in the feeding direction Y in the second nozzle tip 52 is approximately a length 4L.

In the exemplary embodiment, the distance between one of the nozzles Nz at the upstream-side end in the feeding direction Y in the first nozzle tip 51 and one of the nozzles Nz at the downstream-side end in the feeding direction Y in the second nozzle tip 52 is set to a value four times that of a distance when the medium M moves at a feeding operation (length L).

The distance between one of the nozzles Nz at the upstream-side end in the feeding direction Y in the first nozzle tip 51 and one of the nozzles Nz at the downstream-side end in the feeding direction Y in the second nozzle tip 52 may be shorter than the distance four times that of the distance when the medium M moves at a feeding operation (length L), or may be longer than the distance four times that of the distance when the medium M moves at a feeding operation (length L).

Further, in FIG. 3, regions arranged with the nozzles Nz used to actually perform recording with at least one of the inks F and S and the reaction solutions OF and OS in a recording method for the recording device 10, described later, are surrounded by dashed lines.

In FIG. 3, a region ROF and a region ROS surrounded by the dashed lines correspond to the regions arranged with the nozzles Nz used to actually perform recording with the reaction solution Op. Specifically, the nozzles Nz in the region ROF actually perform recording with the first reaction solution OF, whereas the nozzles Nz in the region ROS actually perform recording with the second reaction solution OS.

A region RF and a region RS surrounded by the dashed lines in FIG. 3 are regions arranged with the nozzles Nz used to actually perform recording with the inks F and S (inks W, C, YE, M, and K). Specifically, the nozzles Nz in the region RF actually perform recording with the first ink F (ink W), whereas the nozzles Nz in the region RS actually perform recording with the second inks S (inks C, M, YE, and K).

The first nozzle tip 51 includes the region ROF arranged with the nozzles Nz used to actually perform recording with the first reaction solution OF, and the region RF arranged with the nozzles Nz used to actually perform recording with the first ink F. In the exemplary embodiment, a part of the nozzle groups 55Op provided in the first nozzle tip 51 performs recording with the first reaction solution OF, whereas all of the nozzle groups 55W provided in the first nozzle tip 51 perform recording with the first ink F. A length in the feeding direction Y of the region ROF arranged with the nozzles Nz used to actually perform recording with the first reaction solution OF is one half of a length in the feeding direction Y of the region RF arranged with the nozzles Nz used to actually perform recording with the first ink F.

The second nozzle tip 52 includes the region ROS arranged with the nozzles Nz used to actually perform recording with the second reaction solution OS and the region RS arranged with the nozzles Nz used to actually perform recording with the second inks S. In the exemplary embodiment, a part of the nozzle groups 55Op provided in the second nozzle tip 52 actually performs recording with the second reaction solution OS, whereas all of the nozzle groups 55C, 55M, 55Y, and 55K provided in the second nozzle tip 52 respectively actually perform recording with the second inks S. A length in the feeding direction Y of the region ROS arranged with the nozzles Nz used to actually perform recording with the second reaction solution OS is one half of a length in the feeding direction Y of the region RS arranged with the nozzles Nz used to respectively actually perform recording with the second inks S.

As described above, the flocculants contained in the reaction solutions OF and OS cause the pigments contained in the inks F and S to flocculate.

When the nozzle groups 55Op respectively perform recording with the reaction solutions OF and OS, and the reaction solutions OF and OS form mist and adhere onto the nozzle groups 55W, 55C, 55M, 55Y, and 55K, flocculation reactions occur, i.e., the pigments contained in the inks F and S filled in the nozzles Nz in the nozzle groups 55W, 55C, 55M, 55Y, and 55K flocculate. The flocculated pigments may clog in some of the nozzles Nz. As a result, the nozzles Nz would not be able to appropriately perform recording with the inks F and S.

In the exemplary embodiment, the length in the feeding direction Y of each of the nozzle groups 55Op configured to perform recording with the reaction solutions OF and OS is shorter than, i.e., one half of, the length in the feeding direction Y of each of the nozzle groups 55W, 55C, 55M, 55Y, and 55K configured to perform recording with the inks F and S. This means that, compared with a case when the length in the feeding direction Y of each of the nozzle groups 55Op is identical to the length in the feeding direction Y of each of the nozzle groups 55W, 55C, 55M, 55Y, and 55K configured to perform recording with the inks F and S, even when the nozzle groups 55Op perform recording with the reaction solutions OF and OS, and the reaction solutions OF and OS form a mist, the mist would be less likely to adhere onto the nozzle groups 55W, 55C, 55M, 55Y, and 55K. Therefore, even when the nozzle groups 55Op perform recording with the reaction solutions OF and OS, and the reaction solutions OF and OS form a mist, the mist would be less likely to negatively affect operations (to cause clogging in the nozzles Nz).

Further, when the nozzle groups 55Op arranged with the nozzles Nz configured to perform recording with the reaction solutions OF and OS are arranged at the ends of the nozzle tips 51 and 52 (head unit 50), even when the nozzle groups 55Op perform recording with the reaction solutions OF and OS, and the reaction solutions OF and OS form a mist, the mist would be further less likely to negatively affect operations, compared with a case when the nozzle groups 55Op are not arranged at the ends of the nozzle tips 51 and 52 (head unit 50).

Hereinafter, the nozzles Nz configured to actually perform recording with the first ink F will be referred to as nozzles NF, the nozzles Nz configured to actually perform recording with the second inks S will be referred to as nozzles NS, the nozzles Nz configured to actually perform recording with the first reaction solution OF will be referred to as nozzles NOF, and the nozzles Nz configured to actually perform recording with the second reaction solution OS will be referred to as nozzles NOS.

That is, the nozzles Nz arranged in the region RF are the nozzles NF configured to actually perform recording with the first ink F, the nozzles Nz arranged in the region RS are the nozzles NS configured to actually perform recording with the second inks S, the nozzles Nz arranged in the region ROF are the nozzles NOF configured to actually perform recording with the first reaction solution OF, and the nozzles Nz arranged in the region ROS are the nozzles NOS configured to actually perform recording with the second reaction solution OS.

Method for Generating Recording Data

Figure 4:
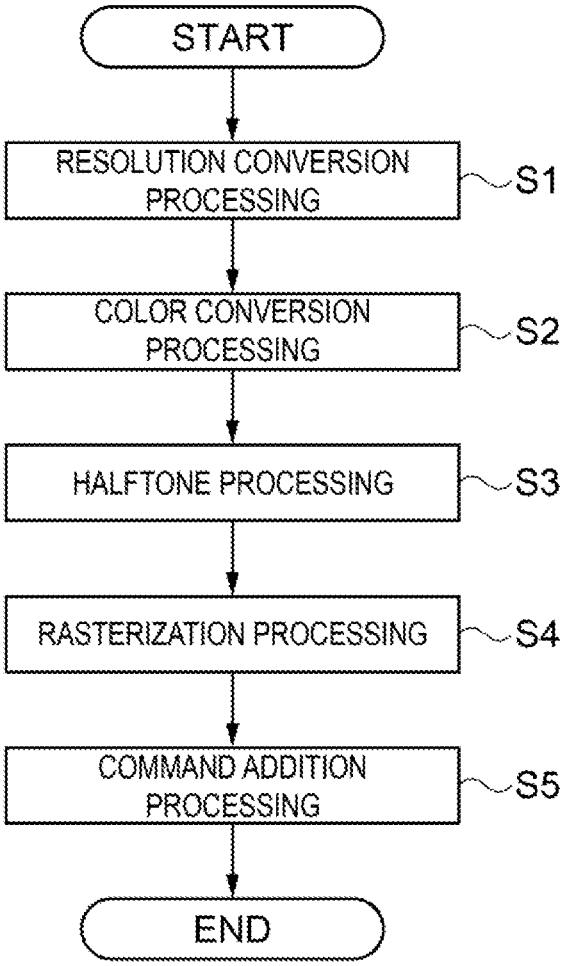
FIG. 4 is a flowchart illustrating a method for generating recording data.

FIG. 4 is a flowchart illustrating a method for generating recording data.

Next, how the control unit 90 executes the method for generating recording data will be described with reference to FIG. 4.

In the recording device 10, the control unit 90 acquires image data output from the PC 110, and generates recording data. Further, the control unit 90 controls the movement unit 20, the head unit 50, and the heating unit 8, for example, based on the recording data, and forms a predetermined image onto the medium M.

As illustrated in FIG. 4, the control unit 90 performs resolution conversion processing (step S1), color conversion processing (step S2), halftone processing (step S3), rasterization processing (step S4), and command addition processing (step S5) to generate recording data.

In step S1, the control unit 90 performs the resolution conversion processing configured to convert resolution of image data output from the PC 110 into resolution used for recording to be performed onto the medium M.

For example, when the recording resolution is specified as 720×720 dpi, vector format image data received from the PC 110 is converted into bitmap format image data having a 720×720 dpi resolution. Each pixel data in the image data after the resolution conversion processing includes pixels arranged in a matrix pattern. Pixel data of the image data having undergone the resolution conversion processing is data indicative of a tone value based on 256 tones in an RGB color space. That is, each piece of the pixel data of the image data after the resolution conversion gives the tone value of the corresponding pixel.

In step S2, the control unit 90 performs the color conversion processing configured to convert RGB data into data of a CMYK color system space.

The color conversion processing is processing for converting RGB data into data of a CMYK color system space. CMYK refers to cyan, magenta, yellow, and black. The image data of the CMYK color system space is data corresponding to the colors of the inks C, M, YE, and K used in the recording device 10. In the exemplary embodiment, the recording device 10 uses five kinds of inks. Therefore, the control unit 90 generates image data having a five-dimensional space in the CMYK color system based on the RGB data.

This color conversion processing is performed based on a color conversion table in which tone values of RGB data and tone values of CMYK color system data are associated with each other. Note that the pixel data after the color conversion processing is the CMYK color system data of 256 tones, for example, expressed in the CMYK color system space. The image data having undergone the color conversion processing includes liquid volumes for the inks W, C, M, YE, and K used for recording onto pixels in a recording region R.

Further, the color conversion table includes data about liquid volumes for the reaction solution Op. The liquid volumes respectively correspond to the liquid volumes for the inks W, C, M, YE, and K. The control unit 90 calculates, based on the color conversion table, liquid volumes for the reaction solution Op to allow the liquid volumes to correspond to liquid volumes for the inks W, C, M, YE, and K used for recording in the pixels within the recording region R.

That is, in step S2, the control unit 90 calculates a liquid volume for the first ink F used for recording onto the medium M, a liquid volume for the first reaction solution OF formed to act on the first ink F used for recording onto the medium M, liquid volumes for the second inks S used for recording onto the medium M, a liquid volume for the first reaction solution OF formed to act on the first ink F used for recording onto the medium M, and a liquid volume for the second reaction solution OS formed to act on the second inks S used for recording onto the medium M.

In step S3, the control unit 90 performs the halftone processing configured to convert data of a high tone number (256 tones) into data of a tone number to allow the recording device 10 to form the data of a tone number. Through this halftone processing, data expressing 256 tones is converted into halftone data for determining dot formation state, such as 1-bit data expressing two tones (dot and no dot) and 2-bit data expressing four tones (no dot, small dot, medium dot, and large dot).

In step S4, the control unit 90 performs the rasterization processing configured to rearrange the pixel data (e.g., the 1-bit or 2-bit halftone data as described above) having a matrix pattern, according to a dot formation order for recording. The rasterization processing includes allocation processing of allocating the image data including the pixel data after the halftone processing (halftone data) to each main scanning in which the head unit 50 keeps moving in the scanning direction X, and performs recording with at least one of the inks F and S and the reaction solutions OF and OS.

In step S5, the control unit 90 performs the command addition processing configured to add command data corresponding to a recording style to the data having undergone the rasterization processing, and to generate recording data. The command data includes, for example, feeding data related to feeding specifications (movement distance in the feeding direction Y and speed, for example) for the medium M.

Recording Method for Recording Device

Figure 5:
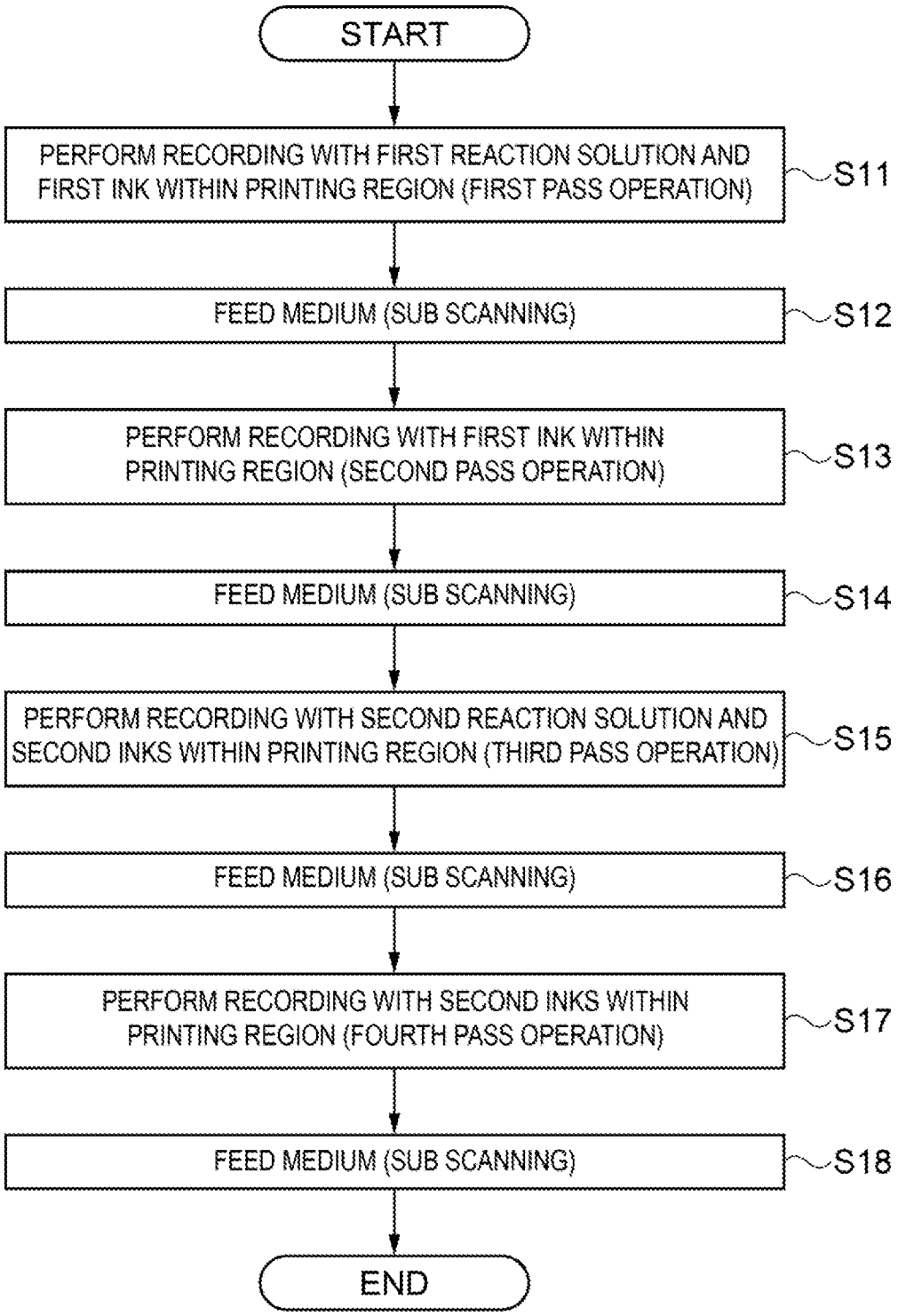
FIG. 5 is a process flow illustrating a recording method for the recording device, according to Exemplary Embodiment 1.
Figure 6:
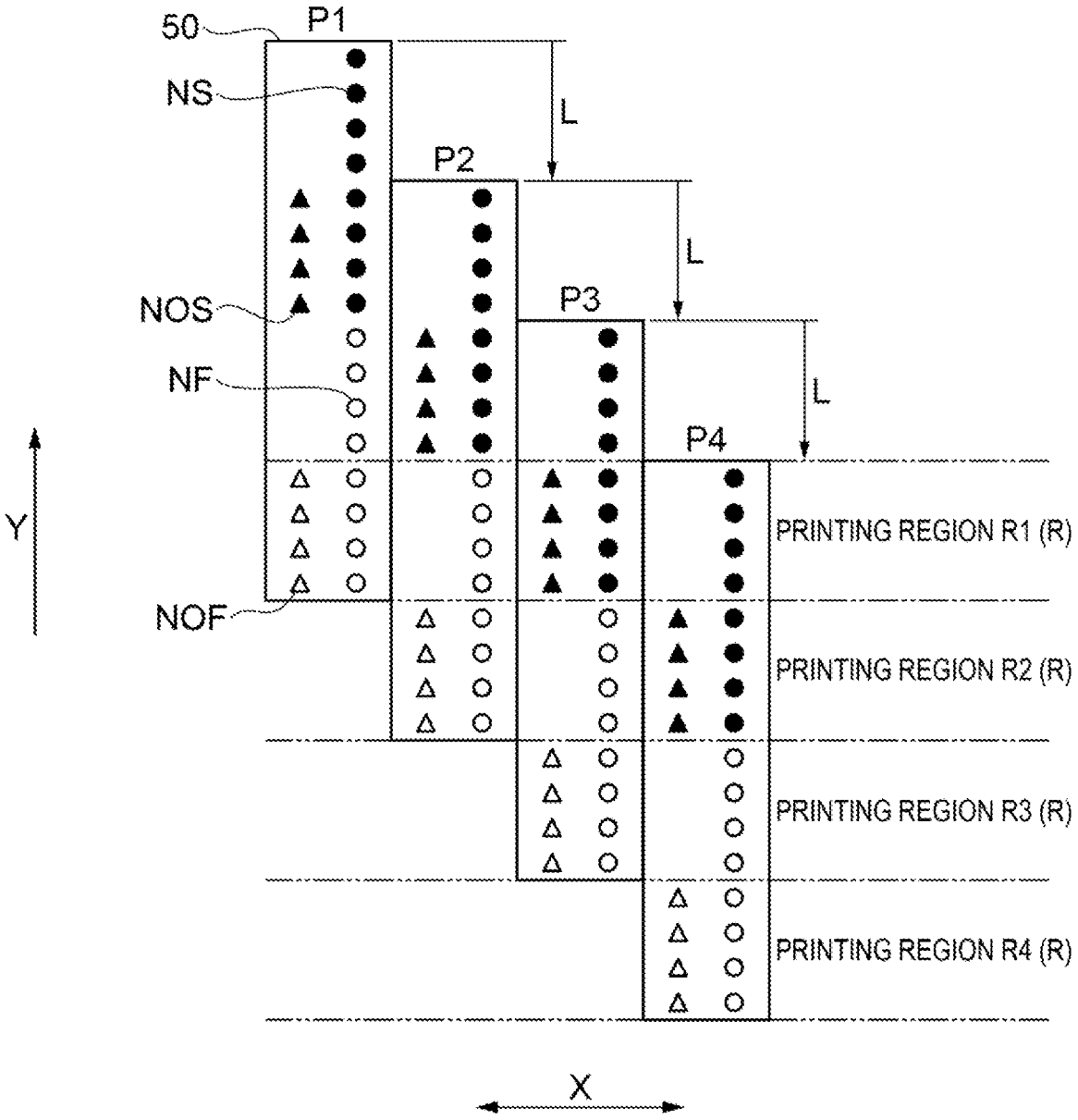
FIG. 6 is an explanatory view of a recording method for the recording device, according to Exemplary Embodiment 1.
Figure 7:
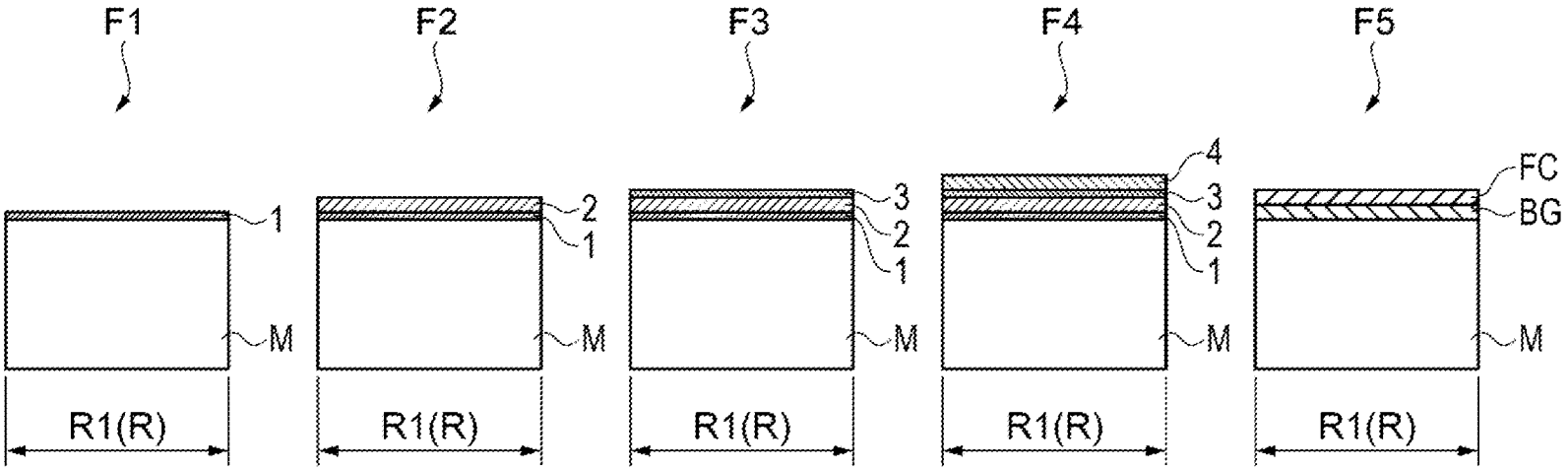
FIG. 7 is a schematic cross-sectional view illustrating states of a medium M after having undergone main processing illustrated in FIG. 5.

FIG. 5 is a process flow illustrating a recording method for the recording device, according to the exemplary embodiment. FIG. 6 is an explanatory view of the recording method for the recording device, according to the exemplary embodiment. FIG. 7 is a schematic cross-sectional view illustrating states of the medium M after having undergone main processing illustrated in FIG. 5.

The head unit 50 illustrated in FIG. 6 is a schematic view in which the head unit 50 illustrated in FIG. 3 is simplified. In the head unit 50 illustrated in FIG. 6, the nozzles NF configured to actually perform recording with the first ink F are illustrated as white circles, the nozzles NS configured to actually perform recording with the second inks S are illustrated as black circles, the nozzles NOF configured to actually perform recording with the first reaction solution OF are illustrated as white triangles, and the nozzles NOS configured to actually perform recording with the second reaction solution OS are illustrated as black triangles.

As illustrated in FIG. 6, the head unit 50 illustrated in FIG. 3 can be illustrated in a state where the nozzles NF and NS are arranged at equal intervals in the feeding direction Y on a side in the scanning direction X, the nozzles NOF and NOS are arranged at equal intervals in the feeding direction Y on another side in the scanning direction X, and a nozzle group arranged with a plurality of the nozzles NOF and a nozzle group arranged with a plurality of the nozzles NOS are away from each other.

The recording device 10 records an image onto the medium M by alternately repeating pass operations (main scanning) in which the head unit 50 keeps performing recording with one or any of the reaction solutions OF and OS and the inks F and S, and moves in the scanning direction X, and feeding operations (sub scanning) in which the medium M is fed in the feeding direction Y.

FIG. 6 illustrates a relative positional relationship between the medium M and the head unit 50 in pass operations (main scanning).

In FIG. 6, a symbol P1 is indicative of a position of the head unit 50 in a first pass operation, a symbol P2 is indicative of a position of the head unit 50 in a second pass operation, a symbol P3 is indicative of a position of the head unit 50 in a third pass operation, and a symbol P4 is indicative of a position of the head unit 50 in a fourth pass operation.

In the recording device 10, a plurality of pass operations are repeated to form an image onto the medium M. For example, when one of the plurality of pass operations is specified as an n-th pass operation, an n+1 pass operation corresponds to the first pass operation, an n+2 pass operation corresponds to the second pass operation, an n+3 pass operation corresponds to the third pass operation, and an n+4 pass operation corresponds to the fourth pass operation.

The first pass operation is an example of a "first pass operation", the second pass operation is an example of a "second pass operation", the third pass operation is an example of a "third pass operation", and the fourth pass operation is an example of a "fourth pass operation".

Further, although FIG. 6 illustrates the positional relationship as if the head unit 50 moves relative to the medium M, the medium M actually moves in the feeding direction Y. In FIG. 6, there is no meaning in a positional relationship of the head unit 50 in the direction X. That is, for ease of convenience and understanding of the recording method for the recording device in FIG. 6, the head unit 50 at P1, the head unit 50 at P2, the head unit 50 at P3, and the head unit 50 at P4 are shifted in position in the scanning direction X.

Further, in FIG. 6, two-dot chain lines illustrate, as the recording region R (recording regions R1, R2, R3, and R4), a region to which the head unit 50 causes the nozzles Nz to perform recording with one or any of the inks F and S and the reaction solutions OF and OS onto the medium M, and recording is performed with one or any of the inks F and S and the reaction solutions OF and OS onto the medium M through a pass operation, i.e., a region to which an image is formed onto the medium M through a single pass operation. In FIG. 6, a length in the feeding direction Y of the recording region R (recording regions R1, R2, R3, and R4) corresponds to the distance when the medium M moves due to a feeding operation (length L).

Further, the recording region R is a region to be formed with an image onto the medium M through a pass operation, i.e., a region on the medium M to be formed with an image through a pass operation. That is, the recording region R denotes a region on the medium M to be formed with an image, and is an example of a "medium used in the recording method for the recording device application".

Hereinafter, the recording regions R1, R2, R3, and R4 will be sometimes collectively referred to as the recording region R, and the recording region R1 will also sometimes be referred to as the recording region R.

A view indicated by a symbol F1 in FIG. 7 is a schematic cross-sectional view illustrating one of the states of the medium M after the first pass operation (step S11 (see FIG. 5)) is performed. A view indicated by a symbol F2 in FIG. 7 is a schematic cross-sectional view illustrating another one of the states of the medium M after the second pass operation (step S13 (see FIG. 5)) is performed. A view indicated by a symbol F3 in FIG. 7 is a schematic cross-sectional view illustrating still another one of the states of the medium M after the third pass operation (step S15 (see FIG. 5)) is performed. A view indicated by a symbol F4 in FIG. 7 is a schematic cross-sectional view illustrating still another one of the states of the medium M after the fourth pass operation (step S17 (see FIG. 5)) is performed.

Further, a view indicated by a symbol F5 in FIG. 7 is a schematic cross-sectional view illustrating still another one of the states of the medium M after the heating processing is performed with the heating unit 8.

Next, an overview of the recording method for the recording device 10, according to the exemplary embodiment, will be described with reference to FIGS. 5 to 7.

As illustrated in FIG. 5, the recording method for the recording device 10, according to the exemplary embodiment, includes performing recording with the first ink F and the first reaction solution OF within the recording region R1 through the first pass operation (step S11), feeding the medium M in the feeding direction Y (step S12), performing recording with the first ink F within the recording region R1 through the second pass operation (step S13), feeding the medium M in the feeding direction Y (step S14), performing recording with the second reaction solution OS and the second inks S within the recording region R1 through the third pass operation (step S15), feeding the medium M in the feeding direction Y (step S16), performing recording with the second inks S within the recording region R1 through the fourth pass operation (step S17), and feeding the medium M in the feeding direction Y (step S18).

Step S11 is an example of "performing recording with the first liquid and the reaction solution through the first pass operation to form a first layer on a medium". Step S13 is an example of "performing recording with the first liquid through the second pass operation to form a second layer on the first layer". Step S15 is an example of "performing recording with the second liquids and the reaction solution through the third pass operation to form a third layer on the second layer". Step S17 is an example of "performing recording with the second liquids through the fourth pass operation to form a fourth layer on the third layer".

As illustrated in FIG. 6, in step S11, the first pass operation is performed, and the control unit 90 controls the head unit 50 to allow the nozzles NOF to perform recording with the first reaction solution OF, and to allow the nozzles NF to perform recording with the first ink F within the recording region R1. As illustrated in the view indicated by the symbol F1 in FIG. 7, a first layer 1 containing the first ink F and the first reaction solution OF is then formed onto the medium M (recording region R1).

That is, in step S11, recording is performed with the first ink F and the first reaction solution OF through the first pass operation to form the first layer 1 onto the medium M.

The medium M is a non-absorption medium or a low absorption medium that is less likely to absorb the inks F and S, and thus is likely to repel the first ink F. Further, the pigments contained in the first ink F have undergone the distribution processing. The surfaces of the pigments are electrically charged. Static electricity causes the pigments to repel each other. Therefore, the pigments would be less likely to flocculate in the first ink F.

When recording is performed with only the first ink F onto the medium M, the first ink F is repelled by the medium M, and would be likely to exit the medium M. Further, the pigments contained in the first ink F would be less likely to flocculate, and thus would be less likely to settle down (adhere) at target positions on the medium M.

Therefore, in step S11, recording is performed with both the first ink F and the first reaction solution OF onto the medium M. The first reaction solution OF contains water, the flocculant, and the surfactant. The surfactant contained in the first reaction solution OF improves wettability of the first ink F with respect to the medium M. Therefore, the first ink F is not repelled by the medium M, but easily and evenly wet-spreads on the surface of the medium M. The flocculant contained in the first reaction solution OF neutralizes electric charge on the surfaces of the pigments to allow the pigments to flocculate. The pigments flocculated by the flocculant then settle down on the surface of the medium M to easily adhere at the target positions on the medium M.

In step S11, a liquid volume for the first reaction solution OF is set to allow flocculation reactions to appropriately occur in not only the pigments in the first ink F used for recording in step S11, but also the pigments in the first ink F used for subsequent recording (step S13).

Next, in step S12, after the medium M is fed in the feeding direction Y, i.e., after sub scanning is performed, step S13 is performed. A distance at which the medium M moves in a single sub scanning operation is the length L.

As illustrated in FIG. 6, in step S13, the second pass operation is performed, and the control unit 90 controls the head unit 50 to allow the nozzles NF to perform recording with the first ink F within the recording region R1, and to allow the nozzles NF and NOF to perform recording with the first ink F and the first reaction solution OF within the recording region R2. As illustrated in the view indicated by the symbol F2 in FIG. 7, a second layer 2 containing the first ink F is then formed on the first layer 1 within the recording region R1.

That is, in step S13, recording is performed with the first ink through the second pass operation to form the second layer 2 on the first layer 1.

In step S13, the first ink F finely wet-spreads on the first layer 1 containing the first ink F. Since recording is performed with the first ink F within the recording region R1 having undergone recording in advance with the first reaction solution OF, the pigments in the first ink F appropriately flocculate and adhere at target positions. Further, by providing step S13, concentration in the white background image BG can be increased.

Next, in step S14, after the medium M is fed in the feeding direction Y, i.e., after sub scanning is performed, step S15 is performed.

As illustrated in FIG. 6, in step S15, the third pass operation is performed, and the control unit 90 controls the head unit 50 to allow the nozzles NS and NOS to perform recording with the second inks S and the second reaction solution OS within the recording region R1, to allow the nozzles NF to perform recording with the first ink F within the recording region R2, and to allow the nozzles NF and NOF to perform recording with the first ink F and the first reaction solution OF within the recording region R3. As illustrated in the view indicated by the symbol F3 in FIG. 7, a third layer 3 containing the second inks S and the second reaction solution OS is then formed on the second layer 2 within the recording region R1.

That is, in step S15, recording is performed with the second inks S and the second reaction solution OS through the third pass operation to form the third layer 3 on the second layer 2.

The reaction solution Op (first reaction solution OF) used for recording in step S11 acts on the first ink F used for recording in steps S11 and S13, is consumed, and does not act on the second inks S used for recording in steps S15 and S17. Therefore, in step S15, recording is performed onto the medium M with the reaction solution Op (second reaction solution OS) formed to act on the second inks S used for recording in steps S15 and S17.

In step S15, the second inks S finely wet-spread on the second layer 2 containing the first ink F. Further, with the second reaction solution OS simultaneously used for recording, the pigments in the second inks S appropriately flocculate and adhere at target positions.

Next, in step S16, after the medium M is fed in the feeding direction Y, i.e., after sub scanning is performed, step S17 is performed.

As illustrated in FIG. 6, in step S17, the fourth pass operation is performed, and the control unit 90 controls the head unit 50 to allow the nozzles NS to perform recording with the second inks S within the recording region R1, to allow the nozzles NS and NOS to perform recording with the second inks S and the second reaction solution OS within the recording region R2, to allow the nozzles NF to perform recording with the first ink F within the recording region R3, and to allow the nozzles NF and NOF to perform recording with the first ink F and the first reaction solution OF within the recording region R4. As illustrated in the view indicated by the symbol F4 in FIG. 7, a fourth layer 4 containing the second inks S is then formed on the third layer 3 within the recording region R1.

That is, in step S17, recording is performed with the second inks S through the fourth pass operation to form the fourth layer 4 on the third layer 3.

In step S17, the second inks S finely wet-spread on the third layer 3 containing the second inks S. Since recording is performed with the second inks S within the recording region R1 having undergone recording in advance with the second reaction solution OS, the pigments in the second inks S appropriately flocculate and adhere at target positions. Further, by providing step S17, concentration in the full color image FC can be increased.

Next, in step S18, after the medium M is fed in the feeding direction Y, i.e., after sub scanning is performed, a next pass operation (main scanning) is performed.

As described above, the main scanning is repeated four times (first pass operation to fourth pass operation) as described above, and the recording region R1 (medium M) is formed with the first layer 1 containing the first reaction solution OF and the first ink F, the second layer 2 containing the first ink F, the third layer 3 containing the second reaction solution OS and the second inks S, and the fourth layer 4 containing the second inks S in order.

For the recording regions R other than the recording region R1 (recording regions R2, R3, and R4, for example), similar to the recording region R1, the main scanning is also repeated four times, and the first layer 1, the second layer 2, the third layer 3, and the fourth layer 4 are also formed in order.

For the recording regions R other than the recording region R1 (recording regions R2, R3, and R4, for example), after the main scanning is repeated four times, and the first layer 1, the second layer 2, the third layer 3, and the fourth layer 4 are formed in order, the heating processing is performed with the heating unit 8.

After the heating processing is performed with the heating unit 8, resin components in the first ink F in the first layer 1 and the second layer 2 melt, resin layers containing the pigments in the first ink F are formed, and the pigments in the first ink F are fixed onto the medium M. As a result, with the resin layers containing the pigments in the first ink F, the white background image BG is formed. Further, resin components in the second inks S in the third layer 3 and the fourth layer 4 melt, resin layers containing the pigments in the second inks S are formed, and the pigments in the second inks S are fixed onto the medium M. As a result, with the resin layers containing the pigments in the second inks S, the full color image FC is formed.

As described above, as the heating processing is performed with the heating unit 8, the white background image BG and the full color image FC are formed in order on the clear medium M.

As described above, in the recording method for the recording device 10, according to the exemplary embodiment, recording is performed with the first ink F and the first reaction solution OF in step S11, recording is performed with the first ink F in step S13, recording is performed with the second inks S and the second reaction solution OS in step S15, recording is performed with the second inks S in step S17, and the first layer 1, the second layer 2, the third layer 3, and the fourth layer 4 are formed in order onto the medium M.

Since, in steps S11 and 15, recording is simultaneously performed with the inks F and S and the reaction solutions OF and OS, productivity of the recording device 10 according to the exemplary embodiment can be increased, compared with a case when recording is separately performed with the inks F and S and the reaction solutions OF and OS.

Exemplary Embodiment 2

Figure 8:
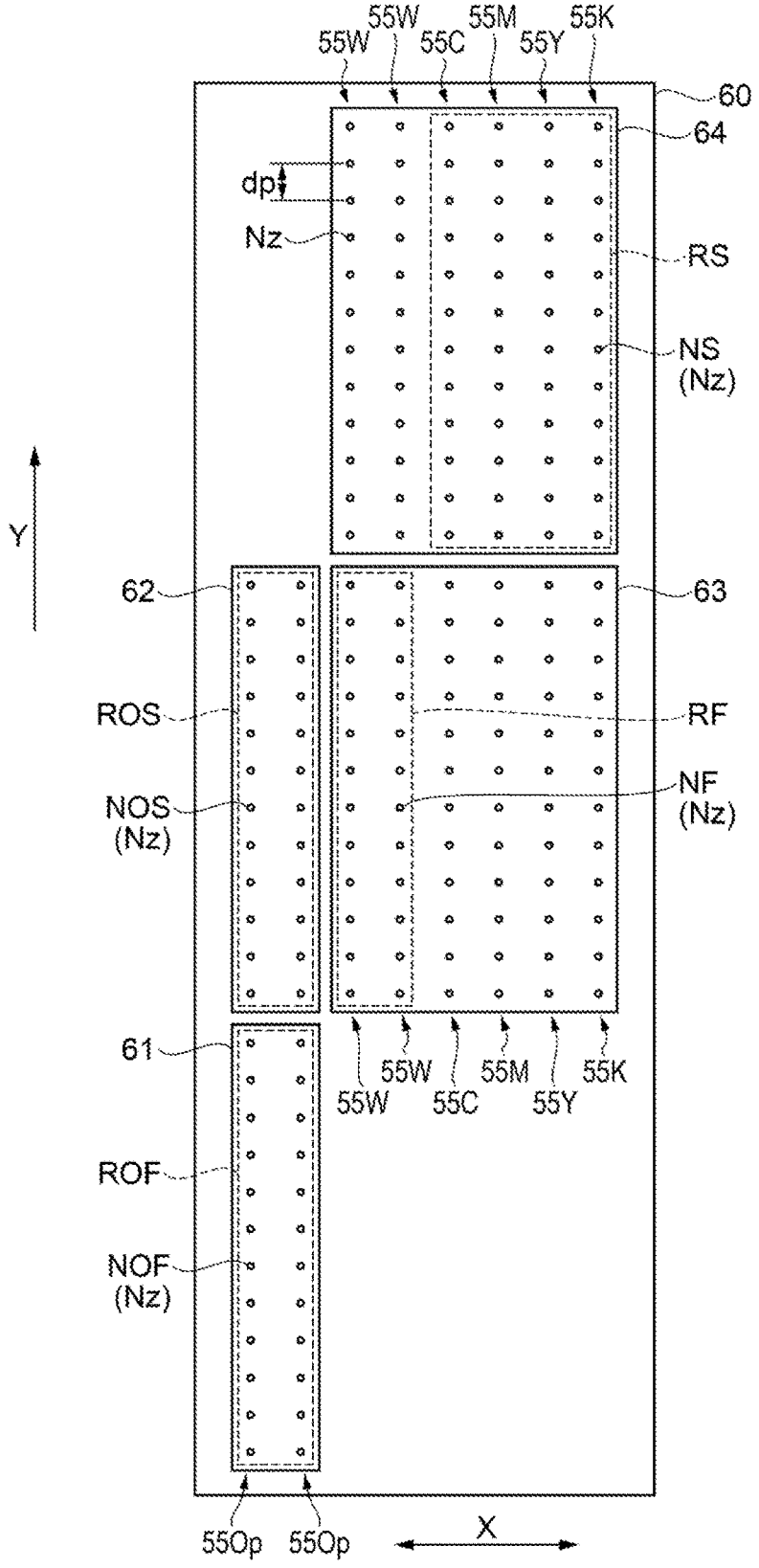
FIG. 8 is a schematic view illustrating an arrangement state of nozzles on a head unit included in a recording device according to Exemplary Embodiment 2.
Figure 9:
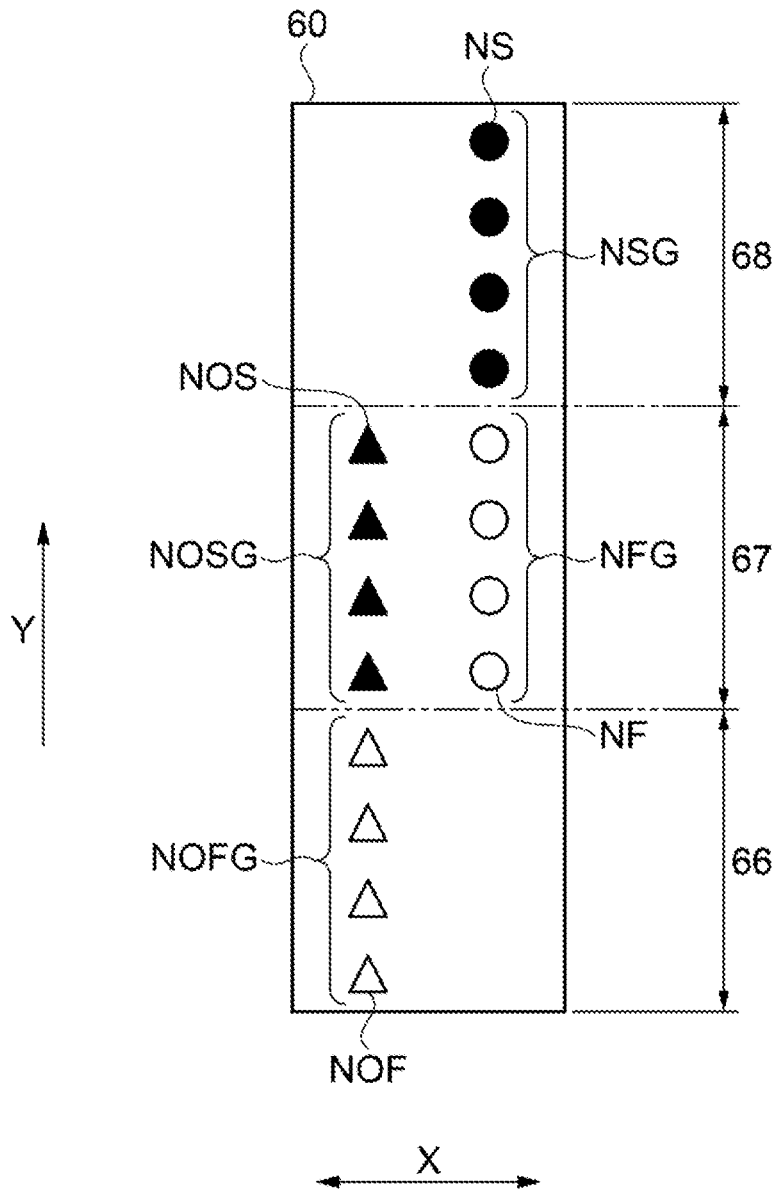
FIG. 9 is another schematic view illustrating the arrangement state of the nozzles on the head unit included in the recording device according to Exemplary Embodiment 2.
Figure 10:
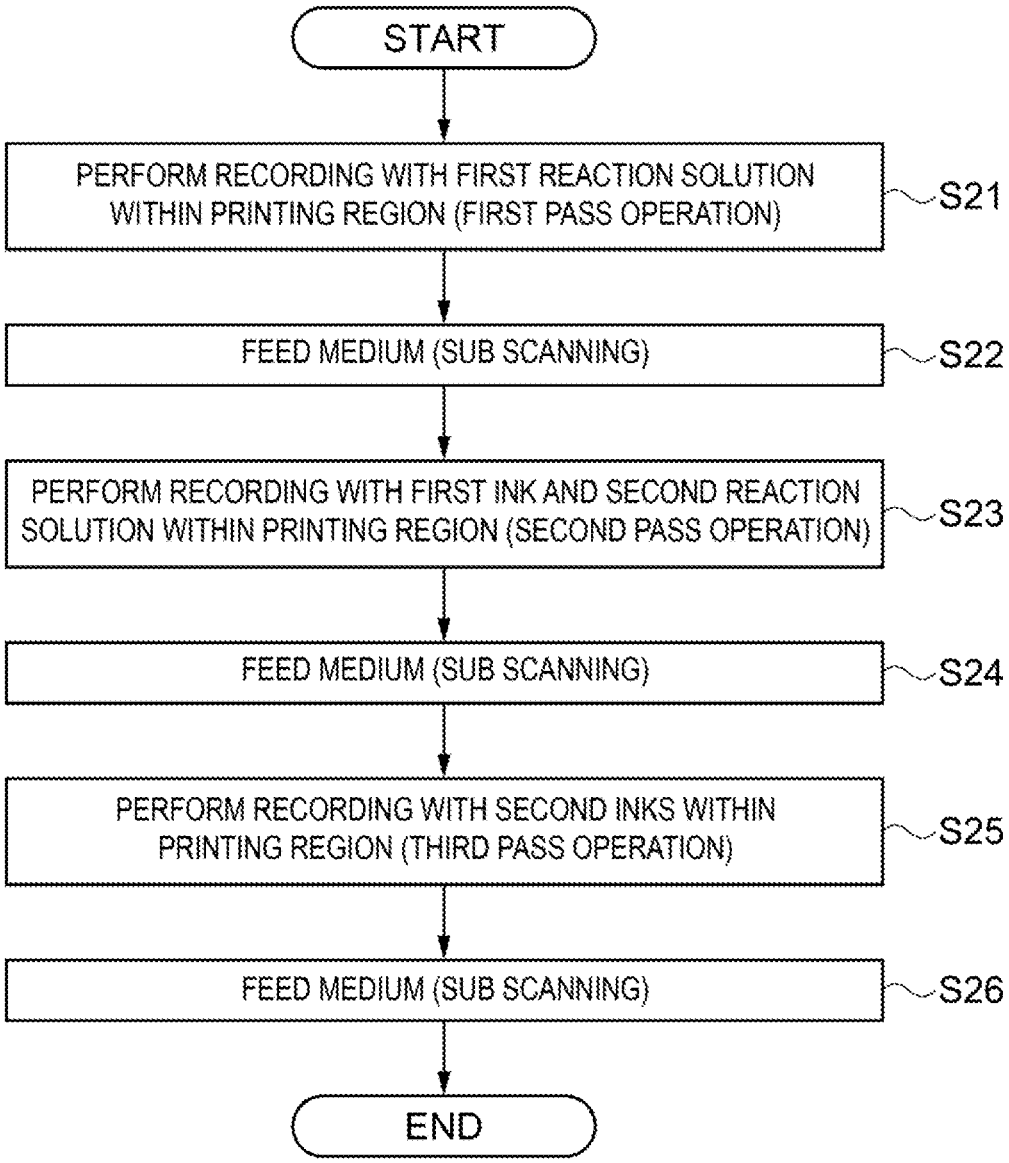
FIG. 10 is a process flow illustrating a recording method for the recording device, according to Exemplary Embodiment 2.
Figure 11:
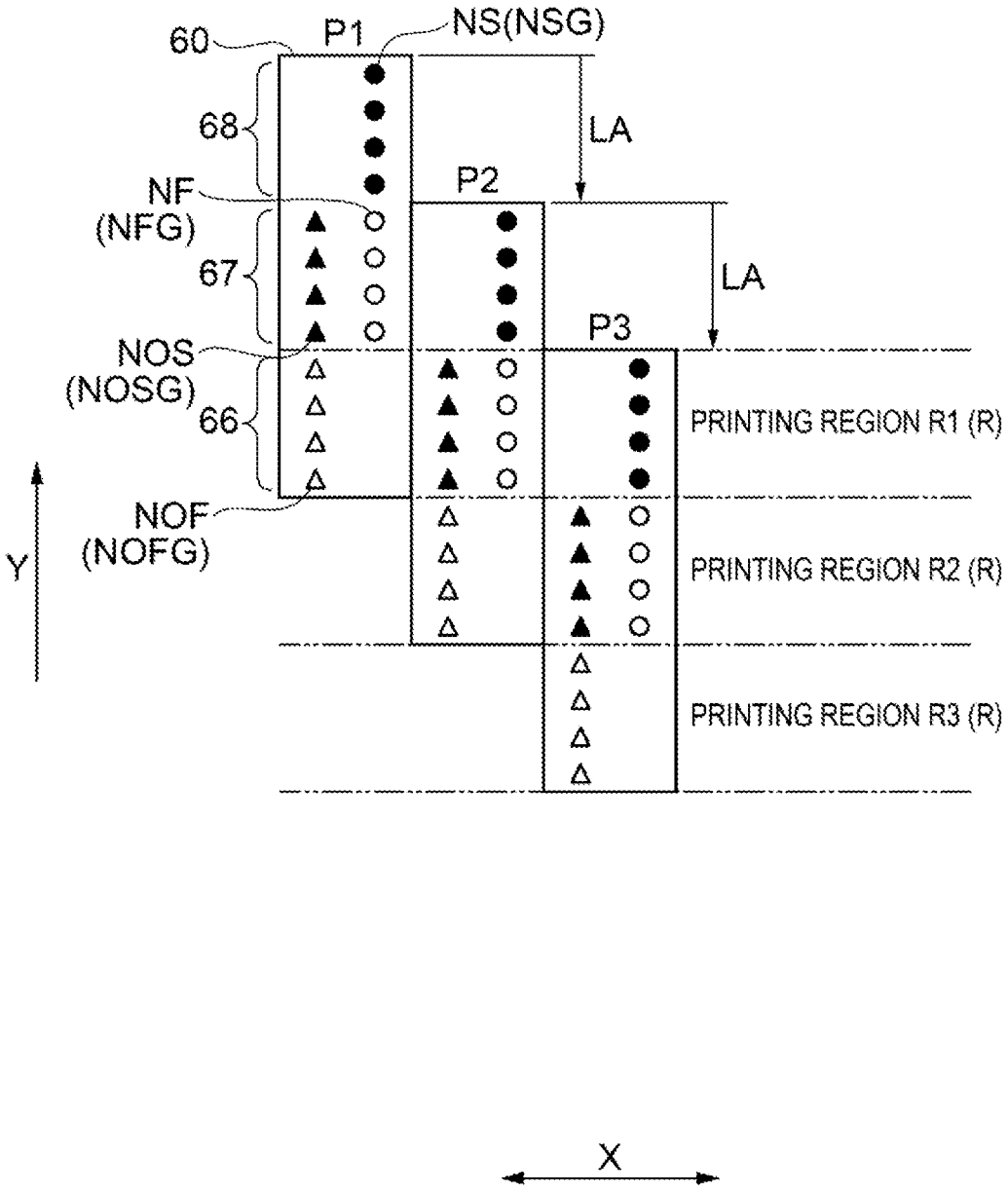
FIG. 11 is an explanatory view of a recording method for the recording device, according to Exemplary Embodiment 2.
Figure 12:
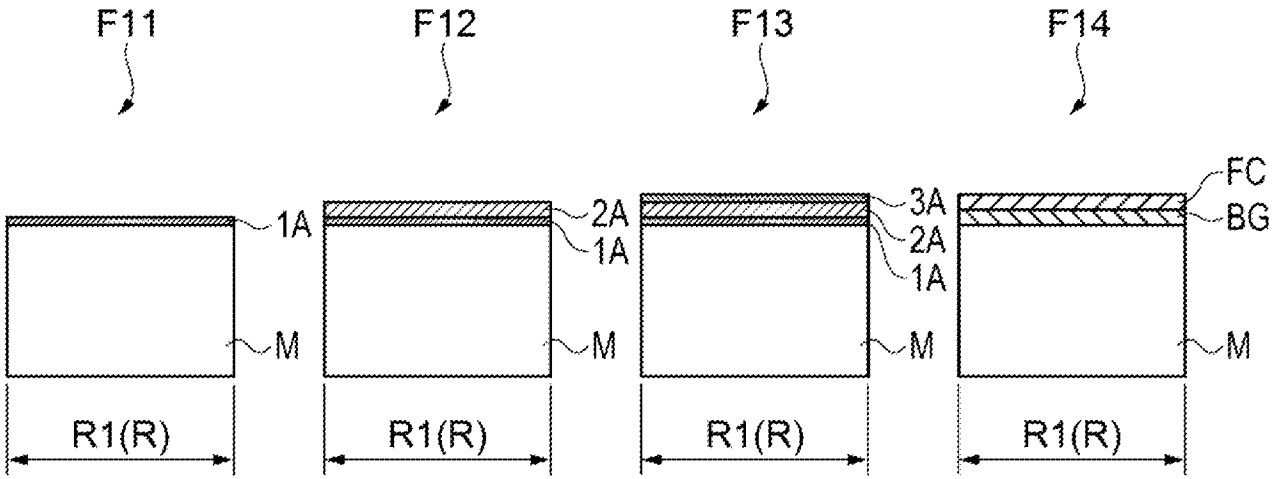
FIG. 12 is a schematic cross-sectional view illustrating states of the medium M after having undergone main processing illustrated in FIG. 10.

FIG. 8 is a view corresponding to FIG. 3, and is a schematic view illustrating an arrangement state of nozzles on a head unit included in a recording device according to Exemplary Embodiment 2. FIG. 9 is another schematic view illustrating the arrangement state of the nozzles on the head unit included in the recording device according to the exemplary embodiment. FIG. 10 is a process flow illustrating a recording method for the recording device, according to the exemplary embodiment. FIG. 11 is a view corresponding to FIG. 6, and is an explanatory view of the recording method for the recording device, according to the exemplary embodiment. FIG. 12 is a view corresponding to FIG. 7, and is a schematic cross-sectional view illustrating states of the medium M after having undergone main processing illustrated in FIG. 10.

A view indicated by a symbol F11 in FIG. 12 is a schematic cross-sectional view illustrating one of the states of the medium M after a first pass operation (step S21 (see FIG. 10)) is performed. A view indicated by a symbol F12 in FIG. 12 is a schematic cross-sectional view illustrating another one of the states of the medium M after a second pass operation (step S23 (see FIG. 10)) is performed. A view indicated by a symbol F13 in FIG. 12 is a schematic cross-sectional view illustrating still another one of the states of the medium M after a third pass operation (step S25 (see FIG. 10)) is performed.

Further, a view indicated by a symbol F14 in FIG. 12 is a schematic cross-sectional view illustrating still another one of the states of the medium M after the heating processing is performed with the heating unit 8.

The state of the head unit and the recording method differ between the recording device according to the exemplary embodiment and the recording device 10 according to Exemplary Embodiment 1. This is the main difference between the recording device according to the exemplary embodiment and the recording device 10 according to Exemplary Embodiment 1.

With reference to FIGS. 8 to 12, an overview of the recording device according to the exemplary embodiment will be described below by focusing on the differences from Exemplary Embodiment 1. Here, the components that are the same as the components in Exemplary Embodiment 1 are referenced using like numbers, and no descriptions for such components are provided below.

The recording device according to the exemplary embodiment first performs recording with the white ink W onto the clear medium M to perform recording of the background image BG (see FIG. 12) onto the clear medium M. Next, the recording device performs recording with the four color inks C, M, YE, and K of cyan, magenta, yellow, and black to perform recording of the full color image FC (see FIG. 12) on the black background image BG.

As illustrated in FIG. 8, a head unit 60 included in the recording device according to the exemplary embodiment includes two nozzle tips 61 and 62 (first nozzle tip 61 and second nozzle tip 62) configured to perform recording with the reaction solution Op (reaction solutions OF and OS), and two nozzle tips 63 and 64 (third nozzle tip 63 and fourth nozzle tip 64) configured to perform recording with the color (white, cyan, magenta, yellow, and black) inks W, C, M, YE, and K (inks F and S).

That is, the head unit 60 according to the exemplary embodiment allows different nozzle tips to perform recording with the reaction solution Op (reaction solutions OF and OS) and the color (white, cyan, magenta, yellow, and black) inks W, C, M, YE, and K (inks F and S). On the other hand, the head unit 50 according to Exemplary Embodiment 1 allows identical nozzle tips to perform recording with the reaction solution Op (reaction solutions OF and OS) and the color (white, cyan, magenta, yellow, and black) inks W, C, M, YE, and K (inks F and S). This is the main difference between the exemplary embodiment and Exemplary Embodiment 1.

The first nozzle tip 61 includes the nozzle groups 55Op arranged with the nozzles Nz configured to perform recording with the first reaction solution OF (reaction solution Op) at equal intervals (nozzle pitch dp) in the feeding direction Y. The second nozzle tip 62 includes the nozzle groups 55Op arranged with the nozzles Nz configured to perform recording with the second reaction solution OS (reaction solution Op) at equal intervals (nozzle pitch dp) in the feeding direction Y. The third nozzle tip 63 and the fourth nozzle tip 64 include the nozzle groups 55W arranged with the nozzles Nz configured to perform recording with the first ink F (ink W) at equal intervals (nozzle pitch dp) in the feeding direction Y, and the nozzle groups 55C, 55M, 55Y, and 55K arranged with the nozzles Nz configured to perform recording with the second inks S (inks C, M, YE, and K) at equal intervals (nozzle pitch dp) in the feeding direction Y.

The first nozzle tip 61 and the second nozzle tip 62 are arranged in order in the feeding direction Y. The first nozzle tip 61 is arranged upstream in the feeding direction Y of the second nozzle tip 62. The third nozzle tip 63 and the fourth nozzle tip 64 are arranged in order in the feeding direction Y. Third nozzle tip 63 is arranged upstream in the feeding direction Y of the fourth nozzle tip 64. The nozzle tips 63 and 64 are arranged on a side in the scanning direction X. The nozzle tips 61 and 62 are arranged on another side in the scanning direction X.

In the first nozzle tip 61, the nozzles Nz in the nozzle groups 55Op actually perform recording with the first reaction solution OF. In the second nozzle tip 62, the nozzles Nz in the nozzle groups 55Op actually perform recording with the second reaction solution OS. In the third nozzle tip 63, the nozzles Nz in the nozzle groups 55W actually perform recording with the first ink F. The nozzle groups 55C, 55M, 55Y, and 55K do not perform recording with the second inks S. In the fourth nozzle tip 64, the nozzles Nz in the nozzle groups 55C, 55M, 55Y, and 55K actually perform recording with the second inks S. The nozzles Nz in the nozzle groups 55W do not perform recording with the first ink F.

The expression "overlap each other in the arrangement direction of the nozzles" in the application denotes that positions in the feeding direction Y are identical to each other.

Positions of the nozzle groups 55Op in the feeding direction Y in the second nozzle tip 62 and positions of the nozzle groups 55W, 55C, 55M, 55Y, and 55K in the feeding direction Y in the third nozzle tip 63 are identical to each other. The nozzle groups 55Op in the second nozzle tip 62 and the nozzle groups 55W, 55C, 55M, 55Y, and 55K in the third nozzle tip 63 overlap each other in the arrangement direction of the nozzles Nz.

Further, when viewed in the scanning direction X, the nozzles NOS configured to actually perform recording with the second reaction solution OS in the second nozzle tip 62 and the nozzles NF configured to actually perform recording with the first ink F in the third nozzle tip 63 overlap each other when viewed in a plan view.

The head unit 60 illustrated in FIG. 9 is a schematic view in which the head unit 60 illustrated in FIG. 8 is simplified. In the head unit 60 illustrated in FIG. 9, the nozzles Nz configured to actually perform recording with one or any of the inks F and S and the reaction solutions OF and OS are illustrated, and illustration of the nozzles Nz that do not perform recording with one or any of the inks F and S and the reaction solutions OF and OS are omitted. In FIG. 9, the nozzles NF configured to actually perform recording with the first ink F are illustrated as white circles, the nozzles NS configured to actually perform recording with the second inks S are illustrated as black circles, the nozzles NOF configured to actually perform recording with the first reaction solution OF are illustrated as white triangles, and the nozzles NOS configured to actually perform recording with the second reaction solution OS are illustrated as black triangles.

In FIG. 9, a nozzle group NFG including the plurality of nozzles NF configured to actually perform recording with the first ink F corresponds to the nozzle groups 55W in FIG. 8, and constitutes an example of a "first nozzle group". A nozzle group NSG including the plurality of nozzles NS configured to actually perform recording with the second inks S corresponds to the nozzle groups 55C, 55M, 55Y, and 55K in FIG. 8, and constitutes an example of a "second nozzle group". A nozzle group NOFG including the plurality of nozzles NOF configured to actually perform recording with the first reaction solution OF and a nozzle group NOSG including the plurality of nozzles NOS configured to actually perform recording with the second reaction solution OS correspond to the nozzle groups 55Op in FIG. 8, and constitute an example of a "third nozzle group".

As illustrated in FIG. 9, the head unit 60 includes the nozzle group NFG including the plurality of nozzles NF configured to actually perform recording with the first ink F, the nozzle group NSG including the plurality of nozzles NS configured to actually perform recording with the second inks S, the nozzle group NOFG including the plurality of nozzles NOF configured to actually perform recording with the first reaction solution OF, and the nozzle group NOSG including the plurality of nozzles NOS configured to actually perform recording with the second reaction solution OS.

In other words, the head unit 60 includes the nozzle group NFG arranged with the nozzles NF configured to perform recording with the first ink, the nozzle group NSG arranged with the nozzles NS configured to perform recording with the second inks S, the nozzle group NOFG arranged with the nozzles NOF configured to perform recording with the reaction solution OF formed to act on the first ink F, and the nozzle group NOSG arranged with the nozzles NOS configured to perform recording with the reaction solution OS formed to act on the second inks S.

The nozzle group NFG and the nozzle group NSG are arranged on a side in the scanning direction X. The nozzle group NOFG and the nozzle group NOSG are arranged on another side in the scanning direction X. The nozzle group NFG is arranged upstream in the feeding direction Y of the nozzle group NSG. The nozzle group NOFG is arranged upstream in the feeding direction Y of the nozzle group NOSG.

A position of the nozzle group NFG in the feeding direction Y and a position of the nozzle group NOSG in the feeding direction Y are identical to each other. The nozzle group NFG and the nozzle group NOSG overlap each other in the arrangement direction of the nozzles Nz.

The head unit 60 includes a portion 67 in which the nozzle group NFG and the nozzle group NOSG overlap each other in the arrangement direction of the nozzles Nz, a portion 66 provided with the nozzle group NOFG, and arranged upstream in the feeding direction Y of the portion 67, and a portion 68 provided with the nozzle group NSG downstream in the feeding direction Y of the portion 67.

The portion 67 is an example of an "overlapping part", the portion 66 is an example of an "upstream-side non-overlapping part", and the portion 68 is an example of a "downstream-side non-overlapping part".

In other words, the head unit 60 includes the overlapping part (portion 67) in which the nozzle group NFG and the nozzle group NOSG overlap each other in the arrangement direction of the nozzles Nz, the upstream-side non-overlapping part (portion 66) provided with the nozzle group NOFG upstream in the feeding direction Y of the portion 67, and the downstream-side non-overlapping part (portion 68) provided with the nozzle group NSG downstream in the feeding direction Y of the portion 67.

As illustrated in FIG. 10, a recording method for the recording device, according to the exemplary embodiment, includes performing recording with the first reaction solution OF within the recording region R1 through a first pass operation (step S21), feeding the medium M in the feeding direction Y (step S22), performing recording with the first ink F and the second reaction solution OS within the recording region R1 through a second pass operation (step S23), feeding the medium M in the feeding direction Y (step S24), performing recording with the second inks S within the recording region R1 through a third pass operation (step S25), and feeding the medium M in the feeding direction Y (step S26).

Step S21 is an example of "performing recording with the reaction solution from the upstream-side non-overlapping part onto a medium to form a first layer through the first pass operation". Step S23 is an example of "performing recording with the first liquid and the reaction solution from the overlapping part to form a second layer on the first layer through the second pass operation". Step S25 is an example of "performing recording with the second liquids from the downstream-side non-overlapping part to form a third layer on the second layer through the third pass operation".

As illustrated in FIG. 11, in step S21, the first pass operation is performed, and the control unit 90 controls the head unit 60 to allow the nozzles NOF in the portion 66 to perform recording with the first reaction solution OF within the recording region R1. As illustrated in the view indicated by the symbol F11 in FIG. 12, a first layer 1A containing the first reaction solution OF is then formed within the recording region R1.

That is, step S21 corresponds to performing recording with the first reaction solution OF from the portion 66 to form the first layer 1A onto the medium M through the first pass operation.

In step S21, a liquid volume for the first reaction solution OF is set to allow flocculation reactions to appropriately occur in the pigments in the first ink F used for subsequent recording (step S23).

Next, in step S22, after the medium M is fed in the feeding direction Y, i.e., after sub scanning is performed, step S23 is performed. A distance at which the medium M moves in a single sub scanning operation is a length LA.

As illustrated in FIG. 11, in step S23, the second pass operation is performed, and the control unit 90 controls the head unit 60 to allow the nozzles NF and NOS in the portion 67 to perform recording with the first ink F and the second reaction solution OS within the recording region R1, and to allow the nozzles NOF in the portion 66 to perform recording with the first reaction solution OF within the recording region R2. As illustrated in the view indicated by the symbol F12 in FIG. 12, a second layer 2A containing the first ink F and the second reaction solution OS is then formed on the first layer 1A within the recording region R1.

That is, step S23 corresponds to performing recording with the first ink F and the second reaction solution OS from the portion 67 to form the second layer 2A on the first layer 1A through the second pass operation.

Since, in step S23, recording is performed with the first ink F within the recording region R1 (first layer 1A) having undergone recording in advance with the first reaction solution OF, the first ink F finely wet-spreads on the first layer 1A, and the pigments in the first ink F appropriately flocculate and adhere at target positions. Further, since recording is performed with the second reaction solution OS together with the first ink F, recording is performed with the second reaction solution OS within the recording region R1.

In step S23, a liquid volume for the second reaction solution OS is set to allow flocculation reactions to appropriately occur in the pigments in the second inks S used for subsequent recording (step S25).

Next, in step S24, after the medium M is fed in the feeding direction Y, i.e., after sub scanning is performed, step S25 is performed.

As illustrated in FIG. 11, in step S25, the third pass operation is performed, and the control unit 90 controls the head unit 60 to allow the nozzles NS in the portion 68 to perform recording with the second inks S within the recording region R1, to allow the nozzles NF and NOS in the portion 67 to perform recording with the first ink F and the second reaction solution OS within the recording region R2, and to allow the nozzles NOF in the portion 66 to perform recording with the first reaction solution OF within the recording region R3. As illustrated in the view indicated by the symbol F13 in FIG. 12, a third layer 3A containing the second inks S is then formed on the second layer 2A within the recording region R1.

That is, step S25 corresponds to performing recording with the second inks S from the portion 68 to form the third layer 3A on the second layer 2A within the recording region R1 through the third pass operation.

In step S25, the second inks S finely wet-spread on the second layer 2A containing the first ink F. Further, since recording is performed with the second inks S within the recording region R1 having undergone recording in advance with the second reaction solution OS, the pigments in the second inks S appropriately flocculate and adhere at target positions.

Next, in step S26, after the medium M is fed in the feeding direction Y, i.e., after sub scanning is performed, a next pass operation (main scanning) is performed.

As described above, the main scanning is repeated three times (first pass operation to third pass operation) as described above, and the recording region R1 (medium M) is formed with the first layer 1A containing the first reaction solution OF, the second layer 2A containing the first ink F and the second reaction solution OS, and the third layer 3A containing the second inks S in order.

For the recording regions R other than the recording region R1 (recording regions R2, R3, and R4, for example), similar to the recording region R1, the main scanning is also repeated three times, and the first layer 1A, the second layer 2A, and the third layer 3A are also formed in order.

For the recording regions R other than the recording region R1 (recording regions R2, R3, and R4, for example), after the main scanning is repeated three times, and the first layer 1A, the second layer 2A, and the third layer 3A are formed in order, the heating processing is performed with the heating unit 8.

After the heating processing is performed with the heating unit 8, resin components in the first ink F in the second layer 2A melt, a resin layer containing the pigments in the first ink F is formed, and the pigments in the first ink F are fixed onto the medium M. As a result, with the resin layer containing the pigments in the first ink F, the white background image BG is formed. Further, resin components in the second inks S in the third layer 3A melt, a resin layer containing the pigments in the second inks S is formed, and the pigments in the second inks S are fixed onto the medium M. As a result, with the resin layer containing the pigments in the second inks S, the full color image FC is formed.

As described above, as the heating processing is performed with the heating unit 8, the white background image BG and the full color image FC are formed in order on the clear medium M.

As described above, in the recording method for the recording device, according to the exemplary embodiment, recording is performed with the first reaction solution OF in step S21, recording is performed with the first ink F and the second reaction solution OS in step S23, recording is performed with the second inks S in step S25, and the first layer 1A, the second layer 2A, and the third layer 3A are formed in order onto the medium M.

Since, in step S23, recording is simultaneously performed with the first ink F and the second reaction solution OS, productivity of the recording device according to the exemplary embodiment can be increased, compared with a case when recording is separately performed with the first ink F and the second reaction solution OS.

Exemplary Embodiment 3

Figure 13:
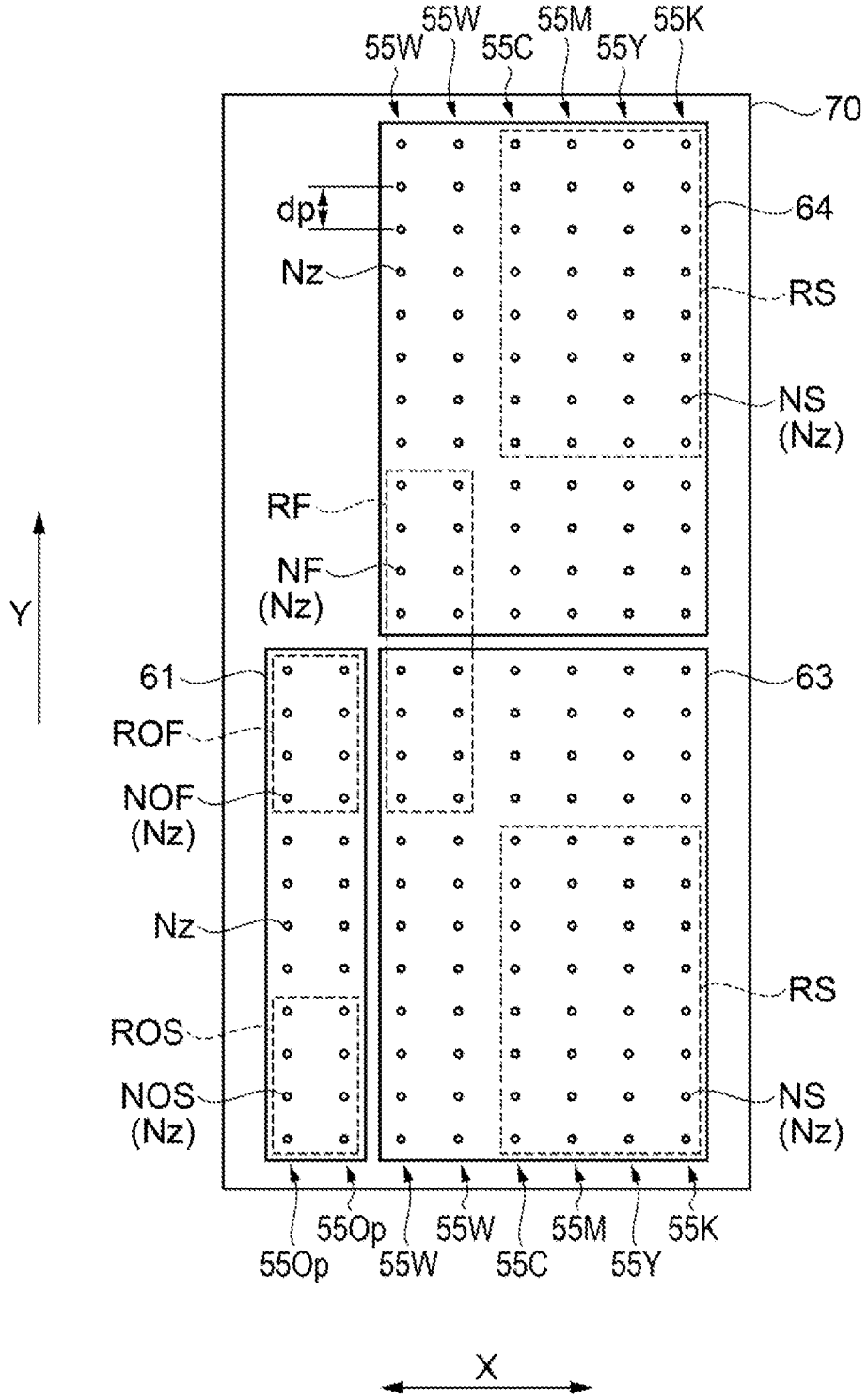
FIG. 13 is a schematic view illustrating an arrangement state of nozzles on a head unit included in a recording device according to Exemplary Embodiment 3.
Figure 14:
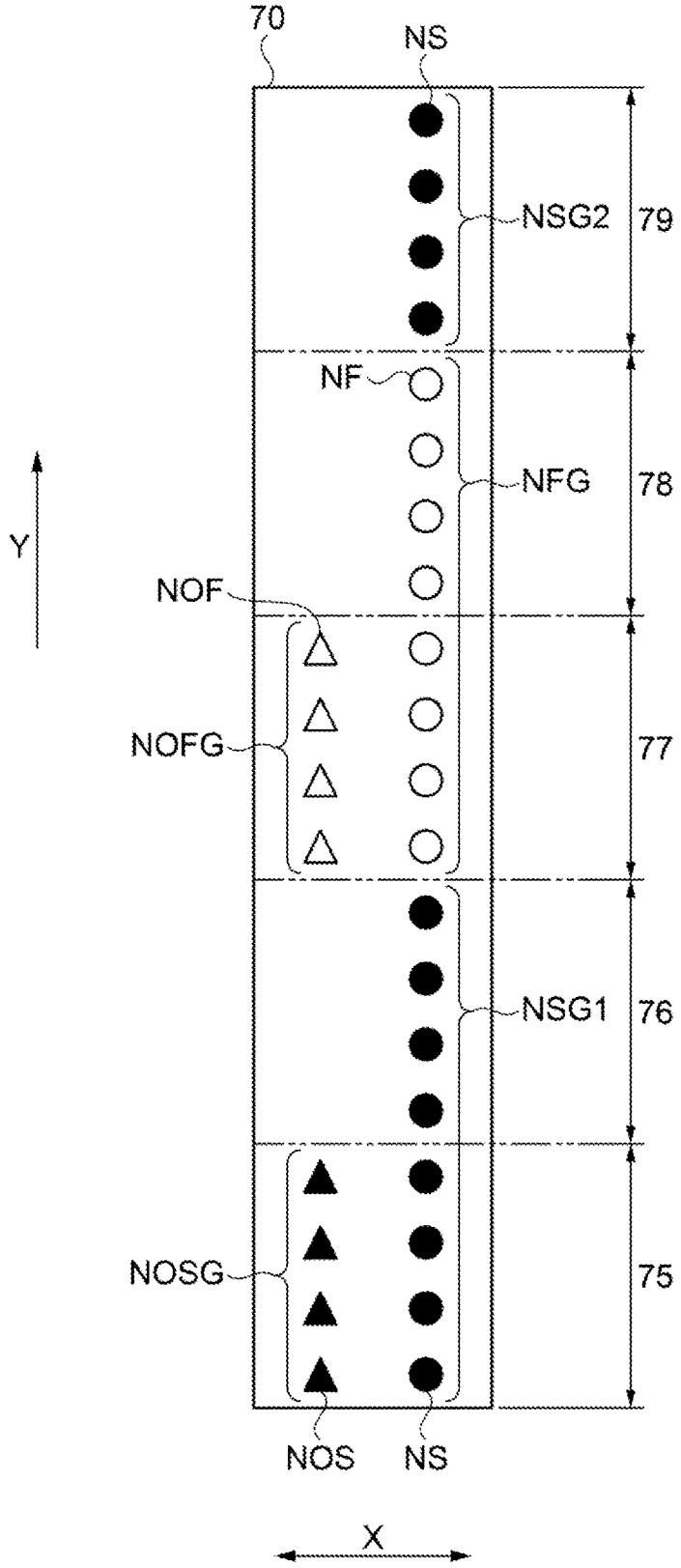
FIG. 14 is another schematic view illustrating the arrangement state of the nozzles on the head unit included in the recording device according to Exemplary Embodiment 3.
Figure 15:
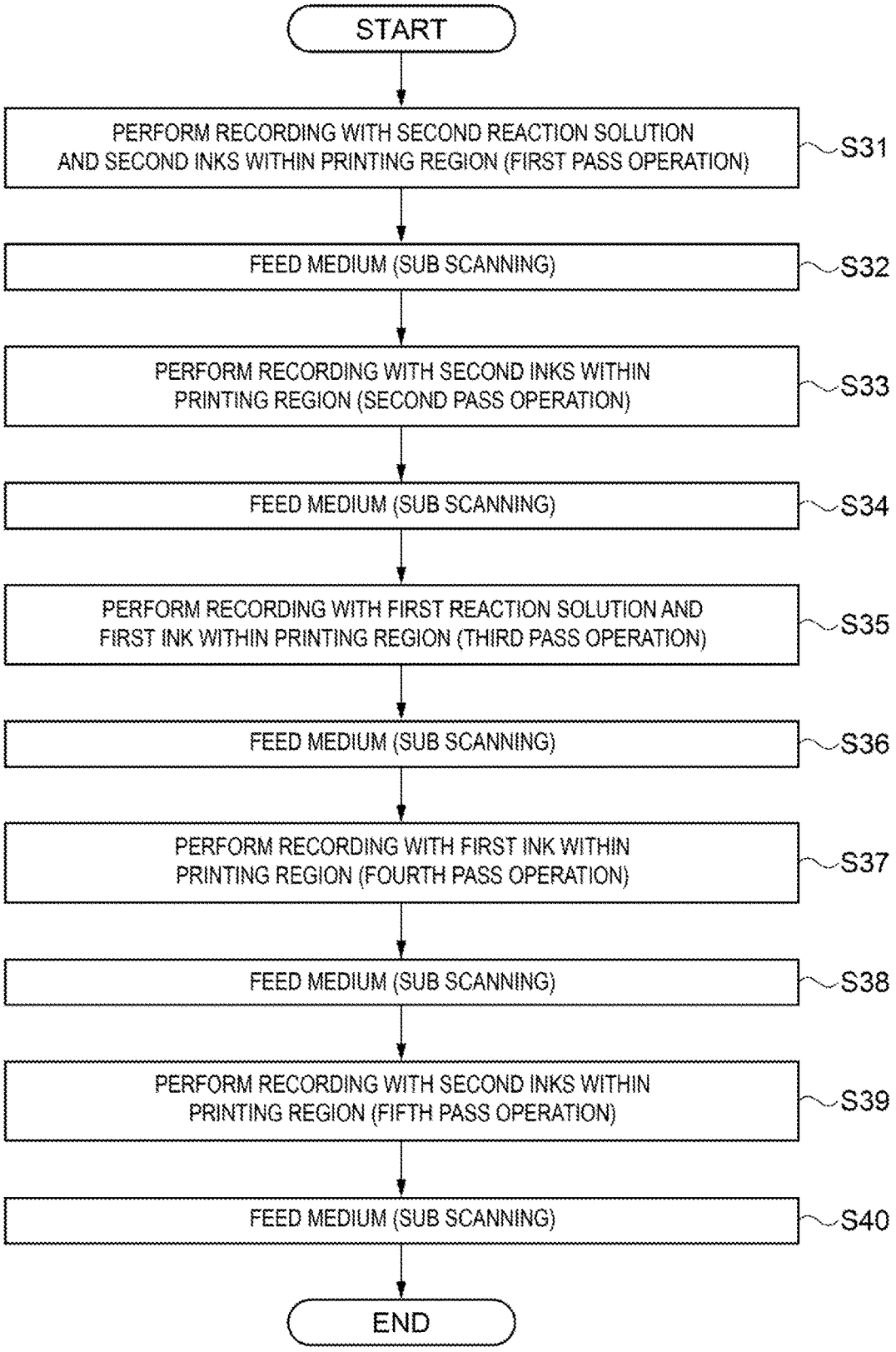
FIG. 15 is a process flow illustrating a recording method for the recording device, according to Exemplary Embodiment 3.
Figure 16:
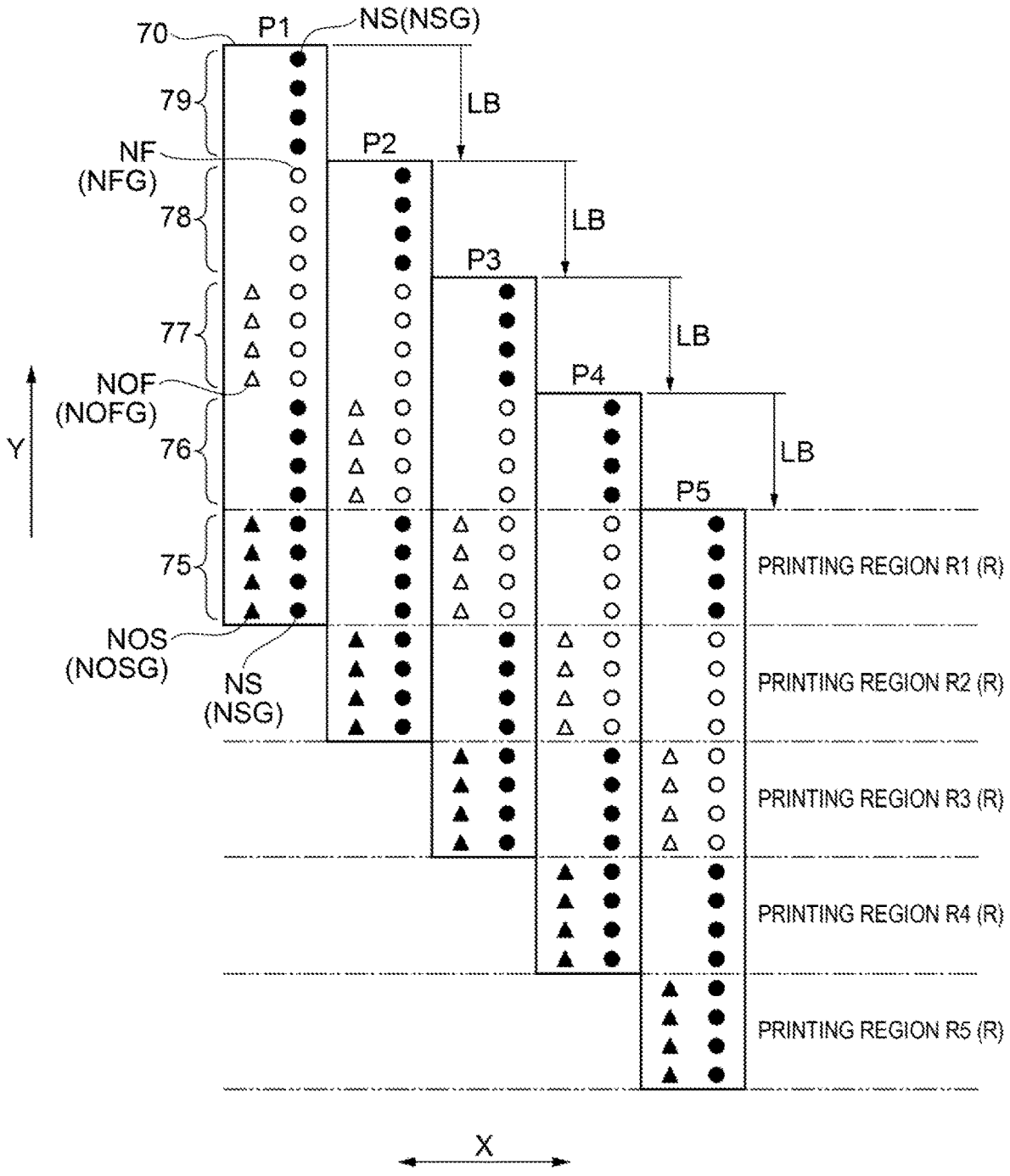
FIG. 16 is an explanatory view of the recording method for the recording device, according to Exemplary Embodiment 3.
Figure 17:
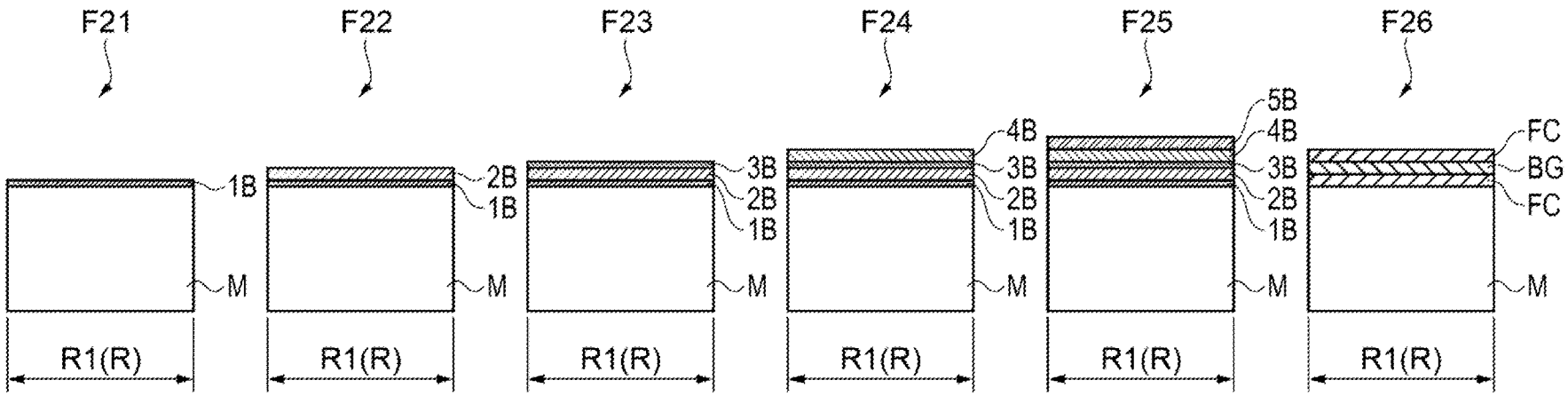
FIG. 17 is a schematic cross-sectional view illustrating states of the medium M after having undergone main processing illustrated in FIG. 15.

FIG. 13 is a view corresponding to FIG. 8, and is a schematic view illustrating an arrangement state of nozzles on a head unit included in a recording device according to Exemplary Embodiment 3. FIG. 14 is a view corresponding to FIG. 9, and is another schematic view illustrating the arrangement state of the nozzles on the head unit included in the recording device according to the exemplary embodiment. FIG. 15 is a process flow illustrating a recording method for the recording device, according to the exemplary embodiment. FIG. 16 is a view corresponding to FIG. 11, and is an explanatory view of the recording method for the recording device, according to the exemplary embodiment. FIG. 17 is a view corresponding to FIG. 12, and is a schematic cross-sectional view illustrating states of the medium M after having undergone main processing illustrated in FIG. 15.

A view indicated by a symbol F21 in FIG. 17 is a schematic cross-sectional view illustrating one of the states of the medium M after a first pass operation (step S31 (see FIG. 15)) is performed. A view indicated by a symbol F22 in FIG. 17 is a schematic cross-sectional view illustrating another one of the states of the medium M after a second pass operation (step S33 (see FIG. 15)) is performed. A view indicated by a symbol F23 in FIG. 17 is a schematic cross-sectional view illustrating still another one of the states of the medium M after a third pass operation (step S35 (see FIG. 15)) is performed. A view indicated by a symbol F24 in FIG. 17 is a schematic cross-sectional view illustrating still another one of the states of the medium M after a fourth pass operation (step S37 (see FIG. 15)) is performed. A view indicated by a symbol F25 in FIG. 17 is a schematic cross-sectional view illustrating still another one of the states of the medium M after a fifth pass operation (step S39 (see FIG. 15)) is performed.

Further, a view indicated by a symbol F26 in FIG. 17 is a schematic cross-sectional view illustrating still another one of the states of the medium M after the heating processing is performed with the heating unit 8.

The state of the head unit and the recording method differ between the recording device according to the exemplary embodiment and the recording device 10 according to Exemplary Embodiment 2. This is the main difference between the recording device according to the exemplary embodiment and the recording device according to Exemplary Embodiment 2.

With reference to FIGS. 13 to 17, an overview of the recording device according to the exemplary embodiment will be described below by focusing on the differences from Exemplary Embodiments 1 and 2. Here, the components that are the same as the components in Exemplary Embodiments 1 and 2 are referenced using like numbers, and no descriptions for such components are provided below.

The recording device according to the exemplary embodiment first performs recording with the four color inks C, M, YE, and K of cyan, magenta, yellow, and black onto the clear medium M to perform recording of the full color image FC (see FIG. 17) onto the clear medium M. Next, the recording device performs recording with the white ink W to perform recording of the white background image BG (see FIG. 17) on the full color image FC. Finally, the recording device performs recording with the four color inks C, M, YE, and K of cyan, magenta, yellow, and black to perform recording of the full color image FC (see FIG. 17) on the white background image BG.

That is, the recording device according to the exemplary embodiment performs recording of the full color image FC, the white background image BG, and the full color image FC in order onto the clear medium M. As a result, the full color image FC can be viewed from both a front of the clear medium M and a back of the clear medium M.

As illustrated in FIG. 13, a head unit 70 included in the recording device according to the exemplary embodiment includes the nozzle tip 61 (first nozzle tip 61) configured to perform recording with the reaction solution Op (reaction solutions OF and OS), and the two nozzle tips 63 and 64 (third nozzle tip 63 and fourth nozzle tip 64) configured to perform recording with the color (white, cyan, magenta, yellow, and black) inks W, C, M, YE, and K (inks F and S).

That is, in the head unit 70 according to the exemplary embodiment, the number of the nozzle tips configured to perform recording with the reaction solution Op (reaction solutions OF and OS) is one fewer than the number of the nozzle tips in the head unit 60 according to Exemplary Embodiment 2.

The first nozzle tip 61 is arranged on another side in the scanning direction X of the third nozzle tip 63. The first nozzle tip 61 includes the nozzles NOF configured to actually perform recording with the first reaction solution OF, the nozzles NOS configured to actually perform recording with the second reaction solution OS, and the nozzles Nz that do not perform recording with the reaction solutions OF and OS.

The third nozzle tip 63 and the fourth nozzle tip 64 are arranged in order in the feeding direction Y. Third nozzle tip 63 is arranged upstream in the feeding direction Y of the fourth nozzle tip 64. The nozzle tips 63 and 64 are arranged on a side in the scanning direction X.

The third nozzle tip 63 and the fourth nozzle tip 64 include the nozzles NF configured to actually perform recording with the first ink F, the nozzles NS configured to actually perform recording with the second inks S, and the nozzles Nz that do not perform recording with the inks F and S.

When viewed in the scanning direction X, the nozzles NOF configured to actually perform recording with the first reaction solution OF in the first nozzle tip 61 and the nozzles NF configured to actually perform recording with the first ink F in the third nozzle tip 63 overlap each other when viewed in a plan view, whereas the nozzles NOS configured to actually perform recording with the second reaction solution OS in the first nozzle tip 61 and the nozzles NS configured to actually perform recording with the second inks S in the third nozzle tip 63 overlap each other when viewed in a plan view.

The head unit 70 illustrated in FIG. 14 is a schematic view in which the head unit 70 illustrated in FIG. 13 is simplified. In the head unit 70 illustrated in FIG. 14, the nozzles Nz configured to actually perform recording with one or any of the inks F and S and the reaction solutions OF and OS are only illustrated, whereas illustration of the nozzles Nz that do not perform recording with one or any of the inks F and S and the reaction solutions OF and OS is omitted. In FIG. 14, the nozzles NF configured to actually perform recording with the first ink F are illustrated as white circles, the nozzles NF configured to actually perform recording with the second inks S are illustrated as black circles, the nozzles NOF configured to actually perform recording with the first reaction solution OF are illustrated as white triangles, and the nozzles NOS configured to actually perform recording with the second reaction solution OS are illustrated as black triangles.

As illustrated in FIG. 14, the head unit 70 includes the nozzle group NFG including the plurality of nozzles NF configured to actually perform recording with the first ink F, two nozzle groups NSG1 and NSG2 including the plurality of nozzles NS configured to actually perform recording with the second inks S, the nozzle group NOFG including the plurality of nozzles NOF configured to actually perform recording with the first reaction solution OF, and the nozzle group NOSG including the plurality of nozzles NOS configured to actually perform recording with the second reaction solution OS.

In other words, the head unit 70 includes the nozzle group NFG arranged with the nozzles NF configured to perform recording with the first ink, the nozzle groups NSG1 and NSG2 arranged with the nozzles NS configured to perform recording with the second inks S, the nozzle group NOFG arranged with the nozzles NOF configured to perform recording with the reaction solution OF formed to act on the first ink F, and the nozzle group and NOSG arranged with the nozzles NOS configured to perform recording with the reaction solution OS formed to act on the second inks S.

The nozzle groups NFG, NSG1, and NSG2 are arranged on a side in the scanning direction X. The nozzle groups NOFG and NOSG are arranged on another side in the scanning direction X.

The nozzle group NSG1 is arranged upstream in the feeding direction Y of the nozzle group NFG. The nozzle group NSG2 is arranged downstream in the feeding direction Y of the nozzle group NFG. The nozzle group NFG is arranged between the nozzle group NSG1 and the nozzle group NSG2.

The nozzle group NOFG is arranged downstream in the feeding direction Y of the nozzle group NOSG.

The nozzle group NFG including the plurality of nozzles NF configured to actually perform recording with the first ink F constitutes an example of a "first nozzle group". The two nozzle groups NSG1 and NSG2 including the plurality of nozzles NS configured to actually perform recording with the second inks S constitute an example of a "second nozzle group". The nozzle group NOFG including the plurality of nozzles NOF configured to actually perform recording with the first reaction solution OF and the nozzle group NOSG including the plurality of nozzles NOS configured to actually perform recording with the second reaction solution OS constitute an example of a "third nozzle group".

Further, the expression "overlap each other in the arrangement direction of the nozzles" in the application denotes that positions in the feeding direction Y are identical to each other.

A position of the nozzle group NOFG in the feeding direction Y and a part of a position of the nozzle group NFG in the feeding direction Y are identical to each other. The nozzle group NOFG and the nozzle group NFG overlap each other in the arrangement direction of the nozzles Nz. A position of the nozzle group NOSG in the feeding direction Y and a part of a position of the nozzle group NSG1 in the feeding direction Y are identical to each other. The nozzle group NOSG and the nozzle group NSG1 overlap each other in the arrangement direction of the nozzles Nz.

The head unit 70 includes a portion 75 in which the nozzle group NOSG and the nozzle group NSG1 overlap each other in the arrangement direction of the nozzles Nz, a portion 76 provided with the nozzle group NSG1 downstream in the feeding direction Y of the portion 75, a portion 77 in which the nozzle group NOFG and the nozzle group NFG overlap each other in the arrangement direction of the nozzles Nz, a portion 78 provided with the nozzle group NFG downstream in the feeding direction Y of the portion 77, and a portion 79 provided with the nozzle group NSG2 downstream in the feeding direction Y of the portion 78. The portion 75, the portion 76, the portion 77, the portion 78, and the portion 79 are arranged in order in the feeding direction Y.

The portion 75 and the portion 77 are examples of "overlapping parts". The portion 76, the portion 78, and the portion 79 are examples of "non-overlapping parts". In other words, the head unit 70 includes overlapping parts (portions 75 and 77) in which the nozzle groups NOFG or NOSG and the nozzle group NFG or the nozzle group NSG overlap each other in the arrangement direction of the nozzles Nz, and non-overlapping parts (portions 76, 78, and 79) provided with the nozzle group NFG or the nozzle group NSG downstream in the feeding direction Y of the overlapping parts (portions 75 and 77).

As illustrated in FIG. 15, a recording method for the recording device, according to the exemplary embodiment, includes performing recording with the second reaction solution OS and the second inks S within the recording region R1 through a first pass operation (step S31), feeding the medium M in the feeding direction Y (step S32), performing recording with the second inks S within the recording region R1 through a second pass operation (step S33), feeding the medium M in the feeding direction Y (step S34), performing recording with the first reaction solution OF and the first ink F within the recording region R1 through a third pass operation (step S35), feeding the medium M in the feeding direction Y (step S36), performing recording with the first ink F within the recording region R1 through a fourth pass operation (step S37), feeding the medium M in the feeding direction Y (step S38), performing recording with the second inks S within the recording region R1 through a fifth pass operation (step S39), and feeding the medium M in the feeding direction Y (step S40).

Step S31 is an example of "performing recording with the second liquids and the reaction solution from one of the overlapping parts to form a first layer onto the medium through a first pass operation". Step S33 is an example of "performing recording with the second liquids from one of the non-overlapping parts to form a second layer on the first layer through a second pass operation". Step S35 is an example of "performing recording with the first liquid and the reaction solution from another one of the overlapping parts to form a third layer on the second layer through a third pass operation". Step S37 is an example of "performing recording with the first liquid from another one of the non-overlapping parts to form a fourth layer on the third layer through a fourth pass operation". Step S39 is an example of "performing recording with the second liquids from still another one of the non-overlapping parts to form a fifth layer on the fourth layer through a fifth pass operation".

As illustrated in FIG. 16, in step S31, the first pass operation is performed, and the control unit 90 controls the head unit 70 to allow the nozzles NS and NOS in the portion 75 to perform recording with the second inks S and the second reaction solution OS within the recording region R1. As illustrated in the view indicated by the symbol F21 in FIG. 17, a first layer 1B containing the second reaction solution OS and the second inks S is then formed within the recording region R1.

That is, step S31 corresponds to performing recording with the second inks S and the second reaction solution OS from the portion 75 to form the first layer 1B onto the medium M through the first pass operation.

Since recording is performed with the second inks S together with the second reaction solution OS, the second inks S wet-spread on the medium M. The pigments in the second inks S thus appropriately flocculate and adhere at target positions. Further, in step S31, a liquid volume for the second reaction solution OS is set to allow flocculation reactions to appropriately occur in not only the pigments in the second inks S used for recording in step S31, but also the pigments in the second inks S used for subsequent recording (step S33).

Next, in step S32, after the medium M is fed in the feeding direction Y, i.e., after sub scanning is performed, step S33 is performed. A distance at which the medium M moves in single sub scanning operation is a length LB.

As illustrated in FIG. 16, in step S33, the second pass operation is performed, and the control unit 90 controls the head unit 70 to allow the nozzles NS in the portion 76 to perform recording with the second inks S within the recording region R1, and to allow the nozzles NS and NOS in the portion 75 to perform recording with the second inks S and the second reaction solution OS within the recording region R2. As illustrated in the view indicated by the symbol F22 in FIG. 17, a second layer 2B containing the second inks S is then formed on the first layer 1B within the recording region R1.

That is, step S33 corresponds to performing recording with the second inks S from the portion 76 to form the second layer 2B on the first layer 1B through the second pass operation.

In step S33, the second inks S finely wet-spread on the first layer 1B containing the second inks S. Since recording is performed with the second inks S within the recording region R1 having undergone recording in advance with the second reaction solution OS, the pigments in the second inks S appropriately flocculate and adhere at target positions.

Next, in step S34, after the medium M is fed in the feeding direction Y, i.e., after sub scanning is performed, step S35 is performed.

As illustrated in FIG. 16, in step S35, the third pass operation is performed, and the control unit 90 controls the head unit 70 to allow the nozzles NF and NOF in the portion 77 to perform recording with the first ink F and the first reaction solution OF within the recording region R1, to allow the nozzles NS in the portion 76 to perform recording with the second inks S within the recording region R2, and to allow the nozzles NS and NOS in the portion 75 to perform recording with the second inks S and the second reaction solution OS within the recording region R3. As illustrated in the view indicated by the symbol F23 in FIG. 17, a third layer 3B containing the first ink F and the first reaction solution OF is then formed on the second layer 2B within the recording region R1.

That is, step S35 corresponds to performing recording with the first ink F and the first reaction solution OF from the portion 77 to form the third layer 3B on the second layer 2B through the third pass operation.

In step S35, the first ink F finely wet-spreads on the second layer 2B containing the second inks S. Since recording is performed with the first ink F together with the first reaction solution OF, the pigments in the first ink F appropriately flocculate and adhere at target positions.

In step S35, a liquid volume for the first reaction solution OF (reaction solution Op) is set to allow flocculation reactions to appropriately occur in not only the pigments in the first ink F used for recording in step S35, but also the pigments in the first ink F used for subsequent recording (step S37) and the pigments in the second inks S used for subsequent recording (step S39).

Next, in step S36, after the medium M is fed in the feeding direction Y, i.e., after sub scanning is performed, step S37 is performed.

As illustrated in FIG. 16, in step S37, the fourth pass operation is performed, and the control unit 90 controls the head unit 70 to allow the nozzles NF in the portion 78 to perform recording with the first ink F within the recording region R1, to allow the nozzles NF and NOF in the portion 77 to perform recording with the first ink F and the first reaction solution OF within the recording region R2, to allow the nozzles NS in the portion 76 to perform recording with the second inks S within the recording region R3, and to allow the nozzles NS and NOS in the portion 75 to perform recording with the second inks S and the second reaction solution OS within the recording region R4. As illustrated in the view indicated by the symbol F24 in FIG. 17, a fourth layer 4B containing the first ink F is then formed on the third layer 3B within the recording region R1.

That is, step S37 corresponds to performing recording with the first ink F from the portion 78 to form the fourth layer 4B on the third layer 3B through the fourth pass operation.

In step S37, the first ink F finely wet-spreads on the third layer 3B containing the first ink F. Since recording is performed with the first ink F within the recording region R1 having undergone recording in advance with the first reaction solution OF (reaction solution Op), the pigments in the first ink F appropriately flocculate and adhere at target positions.

Next, in step S38, after the medium M is fed in the feeding direction Y, i.e., after sub scanning is performed, step S39 is performed.

As illustrated in FIG. 16, in step S39, the fifth pass operation is performed, and the control unit 90 controls the head unit 70 to allow the nozzles NS in the portion 79 to perform recording with the second inks S within the recording region R1, to allow the nozzles NF in the portion 78 to perform recording with the first ink F within the recording region R2, to allow the nozzles NF and NOF in the portion 77 to perform recording with the first ink F and the first reaction solution OF within the recording region R3, to allow the nozzles NS in the portion 76 to perform recording with the second inks S within the recording region R4, and to allow the nozzles NS and NOS in the portion 75 to perform recording with the second inks S and the second reaction solution OS within the recording region R5. As illustrated in the view indicated by the symbol F25 in FIG. 17, a fifth layer 5B containing the second inks S is then formed on the fourth layer 4B within the recording region R1.

That is, step S39 corresponds to performing recording with the second inks S from the portion 79 to form the fifth layer 5B on the fourth layer 4B through the fifth pass operation.

In step S39, the second inks S finely wet-spread on the fourth layer 4B containing the first ink F. Since recording is performed with the second inks S within the recording region R1 having undergone recording in advance with the first reaction solution OF (reaction solution Op), the pigments in the second inks S appropriately flocculate and adhere at target positions.

Next, in step S40, after the medium M is fed in the feeding direction Y, i.e., after sub scanning is performed, a next pass operation (main scanning) is performed.

As described above, the main scanning is repeated five times (first pass operation to fifth pass operation) as described above, and the recording region R1 (medium M) is formed with the first layer 1B containing the second inks S and the second reaction solution OS, the second layer 2B containing the second inks S, the third layer 3B containing the first ink F and the first reaction solution OF, the fourth layer 4B containing the first ink F, and the fifth layer 5B containing the second inks S in order.

For the recording regions R other than the recording region R1 (recording regions R2, R3, and R4, for example), similar to the recording region R1, the main scanning is also repeated five times, and the first layer 1B, the second layer 2B, the third layer 3B, the fourth layer 4B, and the fifth layer 5B are also formed in order.

For the recording regions R other than the recording region R1 (recording regions R2, R3, and R4, for example), after the main scanning is repeated five times, and the first layer 1B, the second layer 2B, the third layer 3B, the fourth layer 4B, and the fifth layer 5B are formed in order, the heating processing is performed with the heating unit 8.

After the heating processing is performed with the heating unit 8, resin components in the second inks S in the first layer 1B and the second layer 2B melt, resin layers containing the pigments in the second inks S are formed, and the pigments in the second inks S are fixed onto the medium M. As a result, with the resin layers containing the pigments in the second inks S, the full color image FC is formed.

Further, resin components in the first ink F in the third layer 3B and the fourth layer 4B melt, resin layers containing the pigments in the first ink F are formed, and the pigments in the first ink F are fixed onto the medium M. As a result, with the resin layers containing the pigments in the first ink F, the background image BG is formed.

Further, resin components in the second inks S in the fifth layer 5B melt, a resin layer containing the pigments in the second inks S is formed, and the pigments in the second inks S are fixed onto the medium M. As a result, with the resin layer containing the pigments in the second inks S, the full color image FC is formed.

As described above, as the heating processing is performed with the heating unit 8, the full color image FC, the white background image BG, and the full color image FC are formed in order on the clear medium M.

As described above, in the recording method for the recording device, according to the exemplary embodiment, recording is performed with the second inks S and the second reaction solution OS in step S31, recording is performed with the second inks S in step S33, recording is performed with the first ink F and the first reaction solution OF in step S35, recording is performed with the first ink F in step S37, recording is performed with the second inks S in step S39, and the first layer 1B, the second layer 2B, the third layer 3B, the fourth layer 4B, and the fifth layer 5B are formed in order onto the medium M.

Since, in steps S31 and S35, recording is simultaneously performed with the inks F and S and the reaction solutions OF and OS, productivity of the recording device according to the exemplary embodiment can be increased, compared with a case when recording is separately performed with the inks F and S and the reaction solutions OF and OS.

The invention is not limited to the above-described exemplary embodiments, but can be appropriately changed within a scope not contrary to the gist or idea of the invention which can be read from the claims and the entire specification, and a variety of modifications other than the above is conceivable. Hereinafter modified examples are described.

Modified Example 1

The above exemplary embodiments have been described based on the serial-head style recording devices respectively configured to allow the head units 50, 60, and 70 to keep moving in the scanning direction X (width direction of the medium M), and to perform recording with the inks C, M, YE, and K. However, such line-head style recording devices may be used that respectively include the head units 50, 60, and 70 arranged and extended in the scanning direction X (width direction of the medium M), and are configured to perform recording with the inks C, M, YE, and K.

Modified Example 2

In Exemplary Embodiment 1 described above, in step S11 and step S13, recording is performed with the first ink (white ink W) onto the medium M to create the white background image BG. As long as a required concentration can be achieved by performing step S11 only, step S13 may be omitted.

Further, in step S15 and step S17, recording is performed with the second inks S (inks C, M, YE, and K) onto the medium M to create the full color image FC. As long as a required concentration can be achieved by performing step S15 only, step S17 may be omitted.

Content derived from the exemplary embodiments described above will be described below.

A recording device according to the application includes a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, the first nozzle group, the second nozzle group, and the third nozzle group overlapping in an arrangement direction of the nozzles, a feeder configured to feed a medium in a feeding direction relatively to the recording unit, a scanner configured to cause the recording unit to perform scanning relatively to the medium in a scanning direction intersecting with the feeding direction, and a controller configured to control the recording unit, the feeder, and the scanner to repeat, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The controller performs recording with the first liquid and the reaction solution to form a first layer on the medium by a first pass operation, performs recording with the first liquid to form a second layer on the first layer by a second pass operation after the first pass operation, performs recording with the second liquid and the reaction solution to form a third layer on the second layer by a third pass operation after the second pass operation, and performs recording with the second liquid to form a fourth layer on the third layer by a fourth pass operation after the third pass operation.

The recording device according to the application performs recording with the first liquid and the reaction solution through the first pass operation, performs recording with the first liquid through the second pass operation, performs recording with the second liquids and the reaction solution through the third pass operation, and performs recording with the second liquids through the fourth pass operation. That is, since recording is performed with the reaction solution together with the liquids (e.g., inks) in the first pass operation and the third pass operation, productivity of the recording device can be increased, compared with a case when recording is separately performed with a reaction solution and recording with liquids.

A recording device according to the application includes a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, a feeder configured to feed a medium in a feeding direction relatively to the recording unit, a scanner configured to cause the recording unit to perform scanning relatively to the medium in a scanning direction intersecting with the feeding direction, and a controller configured to control the recording unit, the feeder, and the scanner to repeat, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording unit includes an overlapping part where the first nozzle group and the third nozzle group overlap in an arrangement direction of the nozzles, an upstream-side non-overlapping part provided with the third nozzle group upstream of the overlapping part in the feeding direction, and a downstream-side non-overlapping part provided with the second nozzle group downstream of the overlapping part in the feeding direction. The controller performs recording with the reaction solution from the upstream-side non-overlapping part to form a first layer on the medium by a first pass operation, performs recording with the first liquid and the reaction solution from the overlapping part to form a second layer on the first layer by a second pass operation after the first pass operation, and performs recording with the second liquid from the downstream-side non-overlapping part to form a third layer on the second layer by a third pass operation after the second pass operation.

The recording device according to the application performs recording with the reaction solution from the upstream-side non-overlapping part through the first pass operation, performs recording with the first liquid and the reaction solution from the overlapping part through the second pass operation, and performs recording with the second liquids from the downstream-side non-overlapping part through the third pass operation. Since recording is performed with the reaction solution together with the liquid in the second pass operation, productivity of the recording device can be increased, compared with a case when recording is separately performed with a reaction solution and a liquid.

A recording device according to the application includes a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, a feeder configured to feed a medium in a feeding direction relatively to the recording unit, a scanner configured to cause the recording unit to perform scanning relatively to the medium in a scanning direction intersecting with the feeding direction, and a controller configured to control the recording unit, the feeder, and the scanner to repeat, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording unit includes an overlapping part where the third nozzle group and the first nozzle group or the second nozzle group overlap in an arrangement direction of the nozzles, and a non-overlapping part provided with the first nozzle group or the second nozzle group downstream of the overlapping parts in the feeding direction. The controller performs recording with the second liquid and the reaction solution from the overlapping part to form a first layer on the medium by a first pass operation, performs recording with the second liquid from the non-overlapping part to form a second layer on the first layer by a second pass operation after the first pass operation, performs recording with the first liquid and the reaction solution from the overlapping part to form a third layer on the second layer by a third pass operation after the second pass operation, performs recording with the first liquid from the non-overlapping part to form a fourth layer on the third layer by a fourth pass operation after the third pass operation, and performs recording with the second liquid from the non-overlapping part to form a fifth layer on the fourth layer by a fifth pass operation after the fourth pass operation.

The recording device according to the application performs recording with the second liquids and the reaction solution from one of the overlapping parts through a first pass operation, performs recording with the second liquids from one of the non-overlapping parts through the second pass operation, performs recording with the first liquid and the reaction solution from another one of the overlapping parts through the third pass operation, performs recording with the first liquid from another one of the non-overlapping parts through the fourth pass operation, and performs recording with the second liquids from still another one of the non-overlapping parts through the fifth pass operation. Since recording is performed with the reaction solution together with the liquids in the first pass operation and the third pass operation, productivity of the recording device can be increased, compared with a case when recording is separately performed with a reaction solution and liquids.

It is preferable that, in a recording device according to the application, the first liquid be a white ink, and the second liquid be a color ink.

When the first liquid is a white ink, and the second liquids are color inks, by performing recording with the first liquid and the reaction solution through the first pass operation, performing recording with the first liquid through the second pass operation, performing recording with the second liquids and the reaction solution through the third pass operation, and performing recording with the second liquids through the fourth pass operation, a white ink image (white image) and a color ink image (full color image) can be formed in order onto a medium.

When the first liquid is a white ink, and the second liquids are color inks, by performing recording with the reaction solution from the upstream-side non-overlapping part through the first pass operation, performing recording with the first liquid and the reaction solution from the overlapping part through the second pass operation, and performing recording with the second liquids from the downstream-side non-overlapping part through the third pass operation, a white image and a full color image can be formed in order onto a medium.

Since a full color image is formed on a white image, visibility of the full color image can be improved, compared with a case when a full color image is not formed on a white image. For example, even when a clear medium is used, a user can finely view a full color image.

When the first liquid is a white ink, and the second liquids are color inks, by performing recording with the second liquids and the reaction solution from one of the overlapping parts through a first pass operation, performing recording with the second liquids from one of the non-overlapping parts through the second pass operation, performing recording with the first liquid and the reaction solution from another one of the overlapping parts through the third pass operation, performing recording with the first liquid from another one of the non-overlapping parts through the fourth pass operation, and performing recording with the second liquids from still another one of the non-overlapping parts through the fifth pass operation, a full color image, a white image, and a full color image can be formed in order onto a medium.

For example, when a full color image, a white background image, and a full color image are formed in order onto a surface of a clear medium, a user can finely view the full color images from not only the surface of the medium but also a back of the medium.

A recording method according to the application is used for a recording device including a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, the first nozzle group, the second nozzle group, and the third nozzle group overlapping in an arrangement direction of the nozzles, a feeder configured to feed a medium in a feeding direction relatively to the recording unit, and a scanner configured to cause the recording unit to perform scanning relatively to the medium in a scanning direction intersecting with the feeding direction. The recording device is configured to perform recording by repeating, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording method for the recording device includes performing recording with the first liquid and the reaction solution to form a first layer on the medium by a first pass operation, performing recording with the first liquid to form a second layer on the first layer by a second pass operation after the first pass operation, performing recording with the second liquids and the reaction solution to form a third layer on the second layer by a third pass operation after the second pass operation, and performing recording with the second liquid to form a fourth layer on the third layer by a fourth pass operation after the third pass operation.

The recording method for the recording device, according to the application, includes performing recording with the first liquid and the reaction solution through the first pass operation, performing recording with the first liquid through the second pass operation, performing recording with the second liquids and the reaction solution through the third pass operation, and performing recording with the second liquids through the fourth pass operation. That is, since recording is performed with the reaction solution together with the liquids in the first pass operation and the third pass operation, productivity of the recording device can be increased, compared with a case when recording is separately performed with a reaction solution and liquids.

A recording method according to the application is used for a recording device including a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, a feeder configured to feed a medium in a feeding direction relatively to the recording unit, a scanner configured to cause the recording unit to perform scanning relatively to the medium in a scanning direction intersecting with the feeding direction. The recording unit includes an overlapping part where the first nozzle group and the third nozzle group overlap in an arrangement direction of the nozzles, an upstream-side non-overlapping part provided with the third nozzle group upstream of the overlapping part in the feeding direction, and a downstream-side non-overlapping part provided with the second nozzle group downstream of the overlapping part in the feeding direction. The recording device is configured to perform recording by repeating, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording method for the recording device includes performing recording with the reaction solution from the upstream-side non-overlapping part to form a first layer on the medium by a first pass operation, performing recording with the first liquid and the reaction solution from the overlapping part to form a second layer on the first layer by a second pass operation after the first pass operation, and performing recording with the second liquid from the downstream-side non-overlapping part to form a third layer on the second layer by a third pass operation after the second pass operation.

The recording method for the recording device, according to the application, includes performing recording with the reaction solution from the upstream-side non-overlapping part through the first pass operation, performing recording with the first liquid and the reaction solution from the overlapping part through the second pass operation, and performing recording with the second liquids from the downstream-side non-overlapping part through the third pass operation. Since recording is performed with the reaction solution together with the liquid in the second pass operation, productivity of the recording device can be increased, compared with a case when recording is separately performed with a reaction solution and a liquid.

A recording method according to the application is used for a recording device including a recording unit including a first nozzle group in which nozzles configured to perform recording with a first liquid are arranged, a second nozzle group in which nozzles configured to perform recording with a second liquid are arranged, and a third nozzle group in which nozzles configured to perform recording with a reaction solution acting on the first liquid and the second liquid are arranged, a feeder configured to feed a medium in a feeding direction relatively to the recording unit, and a scanner configured to cause the recording unit to perform scanning relatively to the medium in a scanning direction intersecting with the feeding direction. The recording unit includes an overlapping part where the third nozzle group and the first nozzle group or the second nozzle group overlap in an arrangement direction of the nozzles, and a non-overlapping part provided with the first nozzle group or the second nozzle group, and arranged downstream of the overlapping part in the feeding direction. The recording device is configured to perform recording by repeating, during a scanning operation causing the recording unit to perform scanning relatively to the medium, a pass operation causing the nozzles to perform recording with at least one of the first liquid, the second liquid, and the reaction solution onto the medium, and a feeding operation causing the recording unit to move relatively to the medium. The recording method for the recording device includes performing recording with the second liquid and the reaction solution from the overlapping part to form a first layer on the medium by a first pass operation, performing recording with the second liquid from the non-overlapping part to form a second layer on the first layer by a second pass operation after the first pass operation, performing recording with the first liquid and the reaction solution from the overlapping part to form a third layer on the second layer by a third pass operation after the second pass operation, performing recording with the first liquid from the non-overlapping part to form a fourth layer on the third layer by a fourth pass operation after the third pass operation, and performing recording with the second liquids from the non-overlapping part to form a fifth layer on the fourth layer by a fifth pass operation after the fourth pass operation.

The recording method for the recording device, according to the application, includes performing recording with the second liquids and the reaction solution from one of the overlapping parts through a first pass operation, performs recording with the second liquids from one of the non-overlapping parts through the second pass operation, performing recording with the first liquid and the reaction solution from another one of the overlapping parts through the third pass operation, performing recording with the first liquid from another one of the non-overlapping parts through the fourth pass operation, and performing recording with the second liquids from still another one of the non-overlapping parts through the fifth pass operation. Since recording is performed with the reaction solution together with the liquids in the first pass operation and the third pass operation, productivity in the recording device can be increased, compared with a case when recording is separately performed with a reaction solution and liquids.

This application claims priority under 35 U.S.C. § 119 to Japanese Patent Application No. 2018-057634, filed Mar. 26 2018. The entire disclosure of Japanese Patent Application No. 2018-057634 is hereby incorporated herein by reference.

What is claimed is:

1. A recording device, comprising:

a recording unit including:

a first nozzle tip configured to perform recording onto a medium with one or more of a first liquid, a second liquid, and a reaction solution acting on the first liquid and the second liquid; and a second nozzle tip configured to perform the recording onto the medium with the one or more of the first liquid, the second liquid, and the reaction solution, wherein the first nozzle tip is arranged upstream in a feeding direction of the medium of the second nozzle tip, wherein each of the first nozzle tip and the second nozzle tip includes:

a first nozzle group in which a plurality of first nozzles configured to perform the recording with the first liquid are arranged, a second nozzle group in which a plurality of second nozzles configured to perform the recording with the second liquid are arranged, and a third nozzle group in which a plurality of third nozzles configured to perform the recording with the reaction solution are arranged, the first nozzle group, the second nozzle group, and the third nozzle group overlapping in an arrangement direction of the plurality of first nozzles, the plurality of second nozzles, and the plurality of third nozzles;

a feeder configured to feed the medium in the feeding direction relatively to the recording unit;

a scanner configured to cause the recording unit to perform scanning relatively to the medium in a scanning direction intersecting with the feeding direction; and a controller configured to control the recording unit, the feeder, and the scanner to repeat, during a scanning operation of the recording unit to perform the scanning relatively to the medium, a pass operation and a feeding operation, wherein the pass operation causes the plurality of first nozzles, the plurality of second nozzles, and the plurality of third nozzles to perform the recording with at least one of the first liquid, the second liquid, or the reaction solution onto the medium, wherein the feeding operation causes the recording unit to move relatively to the medium, and wherein the controller controls the plurality of first nozzles of the first nozzle group of the first nozzle tip and the plurality of third nozzles of the third nozzle group of the first nozzle tip to perform the recording with the first liquid and the reaction solution to form a first layer on the medium by a first pass operation, controls the plurality of first nozzles of the first nozzle group of the first nozzle tip to perform the recording with the first liquid to form a second layer on the first layer by a second pass operation after the first pass operation, controls the plurality of second nozzles of the second nozzle group of the second nozzle tip and the plurality of third nozzles of the third nozzle group of the second nozzle tip to perform the recording with the second liquid and the reaction solution to form a third layer on the second layer by a third pass operation after the second pass operation, and controls the plurality of second nozzles of the second nozzle group of the second nozzle tip to perform the recording with the second liquid to form a fourth layer on the third layer by a fourth pass operation after the third pass operation.

2. The recording device according to claim 1, wherein the first liquid is a white ink, and the second liquid is a color ink.

3. A recording method for a recording device, the recording method including:

feeding, by a feeder, a medium in a feeding direction relatively to a recording unit of the recording device, wherein the recording unit includes:

a first nozzle tip configured to perform recording onto the medium with one or more of a first liquid, a second liquid, and a reaction solution acting on the first liquid and the second liquid; and a second nozzle tip configured to perform the recording onto the medium with the one or more of the first liquid, the second liquid, and the reaction solution, wherein the first nozzle tip is arranged upstream in the feeding direction of the medium of the second nozzle tip, wherein each of the first nozzle tip and the second nozzle tip includes:

a first nozzle group in which a plurality of first nozzles configured to perform the recording with the first liquid are arranged, a second nozzle group in which a plurality of second nozzles configured to perform the recording with the second liquid are arranged, and a third nozzle group in which a plurality of third nozzles configured to perform the recording with the reaction solution are arranged, the first nozzle group, the second nozzle group, and the third nozzle group overlapping in an arrangement direction of the plurality of first nozzles, the plurality of second nozzles, and the plurality of third nozzles;

causing, by a scanner, the recording unit to perform scanning relatively to the medium in a scanning direction intersecting with the feeding direction;

performing the recording by repeating, during a scanning operation causing the recording unit to perform the scanning relatively to the medium, a pass operation and a feeding operation, wherein the pass operation causes the plurality of first nozzles, the plurality of second nozzles, and the plurality of third nozzles to perform the recording with at least one of the first liquid, the second liquid, or the reaction solution onto the medium, and wherein the feeding operation causes the recording unit to move relatively to the medium;

controlling the plurality of first nozzles of the first nozzle group of the first nozzle tip and the plurality of third nozzles of the third nozzle group of the first nozzle tip to perform the recording with the first liquid and the reaction solution to form a first layer on the medium by a first pass operation;

controlling the plurality of first nozzles of the first nozzle group of the first nozzle tip to perform the recording with the first liquid to form a second layer on the first layer by a second pass operation after the first pass operation;

controlling the plurality of second nozzles of the second nozzle group of the second nozzle tip and the plurality of third nozzles of the third nozzle group of the second nozzle tip to perform the recording with the second liquid and the reaction solution to form a third layer on the second layer by a third pass operation after the second pass operation; and controlling the plurality of second nozzles of the second nozzle group of the second nozzle tip to perform the recording with the second liquid to form a fourth layer on the third layer by a fourth pass operation after the third pass operation.

4. The recording device according to claim 1, wherein the controller controls a first part of the plurality of first nozzles of the first nozzle group of the first nozzle tip to perform the recording with the first liquid in the first pass operation, controls a second part of the plurality of first nozzles of the first nozzle group of the first nozzle tip to perform the recording with the first liquid in the second pass operation, wherein the second part of the plurality of first nozzles of the first nozzle group of the first nozzle tip is different from the first part of the plurality of first nozzles of the first nozzle group of the first nozzle tip, controls a first part of the plurality of second nozzles of the second nozzle group of the second nozzle tip to perform the recording with the second liquid in the third pass operation, and controls a second part of the plurality of second nozzles of the second nozzle group of the second nozzle tip to perform the recording with the second liquid in the fourth pass operation, wherein the second part of the plurality of second nozzles of the second nozzle group of the second nozzle tip is different from the first part of the plurality of second nozzles of the second nozzle group of the second nozzle tip.

5. The recording device according to claim 1, wherein an interval between a nozzle at a downstream-side end in the feeding direction of the first nozzle tip and a nozzle at an upstream-side end in the feeding direction of the second nozzle tip is equal to a nozzle pitch between the first nozzle tip and the second nozzle tip.

6. The recording method according to claim 3, further including:

controlling a first part of the plurality of first nozzles of the first nozzle group of the first nozzle tip to perform the recording with the first liquid in the first pass operation, controlling a second part of the plurality of first nozzles of the first nozzle group of the first nozzle tip to perform the recording with the first liquid in the second pass operation, wherein the second part of the plurality of first nozzles of the first nozzle group of the first nozzle tip is different from the first part of the plurality of first nozzles of the first nozzle group of the first nozzle tip, controlling a first part of the plurality of second nozzles of the second nozzle group of the second nozzle tip to perform the recording with the second liquid in the third pass operation, and controlling a second part of the plurality of second nozzles of the second nozzle group of the second nozzle tip to perform the recording with the second liquid in the fourth pass operation, wherein the second part of the plurality of third nozzles of the third nozzle group of the second nozzle tip is different from the first part of the plurality of third nozzles of the third nozzle group of the second nozzle tip.

7. The recording method according to claim 3, wherein an interval between a nozzle at a downstream-side end in the feeding direction of the first nozzle tip and a nozzle at an upstream-side end in the feeding direction of the second nozzle tip is equal to a nozzle pitch between the first nozzle tip and the second nozzle tip.

* * * * *